US011326311B2

(12) United States Patent
Robinson

(10) Patent No.: US 11,326,311 B2
(45) **Date of Patent: *May 10, 2022**

(54) DURABLE JOINT SEAL SYSTEM WITH FLEXIBLY ATTACHED COVER PLATE AND RIB

(71) Applicant: Schul International Co., LLC, Hudson, NH (US)

(72) Inventor: Steven R. Robinson, Windham, NH (US)

(73) Assignee: SCHUL INTERNATIONAL CO., LLC, Pelham, NH (US)

( * ) Notice: Subject to any disclaimer, the term of this patent is extended or adjusted under 35 U.S.C. 154(b) by 303 days.

This patent is subject to a terminal disclaimer.

(21) Appl. No.: 16/386,494

(22) Filed: Apr. 17, 2019

(65) Prior Publication Data

US 2019/0242070 A1 Aug. 8, 2019

Related U.S. Application Data

(63) Continuation-in-part of application No. 15/846,387, filed on Dec. 19, 2017, now Pat. No. 10,323,360, which is a continuation-in-part of application No. 15/702,211, filed on Sep. 12, 2017, now Pat. No. 10,240,302, which is a continuation-in-part of application No. 15/649,927, filed on Jul. 14, 2017, now Pat. No. 9,840,814, which is a continuation of application No. 15/062,354, filed on Mar. 7, 2016, now Pat. No. 9,765,486.

(51) Int. Cl.

| | |
|---|---|
| ***E01C 11/12*** | (2006.01) |
| ***E04B 1/68*** | (2006.01) |
| ***E01C 11/10*** | (2006.01) |

(52) U.S. Cl.
CPC ..... *E01C 11/126* (2013.01); *E01C 11/106* (2013.01); *E04B 1/6801* (2013.01); *E04B 1/6804* (2013.01); *E04B 1/6812* (2013.01)

(58) Field of Classification Search
CPC .... E01C 11/126; E04B 1/6801; E04B 1/6804; E04B 1/6812
See application file for complete search history.

(56) References Cited

U.S. PATENT DOCUMENTS

| | | | | |
|---|---|---|---|---|
| 3,394,639 A * | 7/1968 | Viehmann | E04B 1/68 | 404/47 |
| 4,058,947 A * | 11/1977 | Earle | E04B 1/6801 | 52/396.01 |
| 4,184,298 A * | 1/1980 | Balzer | E01C 11/126 | 14/73.1 |
| 5,335,466 A * | 8/1994 | Langohr | E04B 1/6801 | 52/396.04 |
| 6,039,503 A * | 3/2000 | Cathey | E01C 11/10 | 14/73.1 |

(Continued)

*Primary Examiner* — Eugene G Byrd
(74) *Attorney, Agent, or Firm* — Crain Caton & James; James E. Hudson, III

(57) ABSTRACT

A system which creates a durable seal between adjacent horizontal panels, including those that may be curved or subject to temperature expansion and contraction or mechanical shear. The durable seal system incorporates a plurality of ribs, a flexible member between the cover plate and the ribs and may incorporate a load transfer plate to provide support to the rib from below, and/or cores of differing compressibilities.

34 Claims, 6 Drawing Sheets

(56) References Cited

U.S. PATENT DOCUMENTS 6,532,708 B1 * 3/2003 Baerveldt ..... E01D 19/06 404/47
8,317,444 B1 11/2012 Hensley
8,341,908 B1 * 1/2013 Hensley ..... E04B 1/941 52/396.01
8,365,495 B1 2/2013 Witherspoon
8,739,495 B1 6/2014 Witherspoon
8,813,449 B1 8/2014 Hensley et al.
8,813,450 B1 8/2014 Hensley et al.
8,870,506 B2 10/2014 Hensley et al.
9,068,297 B2 6/2015 Hensley et al.
9,200,437 B1 12/2015 Hensley et al.
9,206,596 B1 12/2015 Robinson
9,322,163 B1 * 4/2016 Hensley ..... E04B 1/6813
9,404,581 B1 * 8/2016 Robinson ..... F16J 15/065
9,528,262 B2 12/2016 Witherspoon
9,631,362 B2 4/2017 Hensley et al.
9,637,915 B1 5/2017 Hensley et al.
9,644,368 B1 5/2017 Witherspoon
9,670,666 B1 6/2017 Witherspoon et al.
9,689,157 B1 6/2017 Hensley et al.
9,689,158 B1 6/2017 Hensley et al.
9,739,049 B1 8/2017 Robinson
9,739,050 B1 8/2017 Hensley et al.
9,745,738 B2 8/2017 Robinson
9,765,486 B1 9/2017 Robinson
9,803,357 B1 10/2017 Robinson
9,840,814 B2 12/2017 Robinson
9,850,662 B2 12/2017 Hensley
9,856,641 B2 1/2018 Robinson
9,915,038 B2 * 3/2018 Robinson ..... E04B 1/6812
9,951,515 B2 4/2018 Robinson
9,963,872 B2 5/2018 Hensley et al.
9,982,428 B2 5/2018 Robinson
9,982,429 B2 5/2018 Robinson
9,995,036 B1 6/2018 Robinson
10,000,921 B1 6/2018 Robinson
10,060,122 B2 8/2018 Robinson
10,066,386 B2 9/2018 Robinson
10,066,387 B2 9/2018 Hensley et al.
10,081,939 B1 9/2018 Robinson
10,087,619 B1 10/2018 Robinson
10,087,620 B1 10/2018 Robinson
10,087,621 B1 10/2018 Robinson
10,072,413 B2 11/2018 Hensley et al.
10,125,490 B2 11/2018 Robinson
10,179,993 B2 1/2019 Hensley et al.
10,203,035 B1 2/2019 Robinson
10,213,962 B2 2/2019 Robinson
10,227,734 B1 3/2019 Robinson
10,233,633 B2 3/2019 Robinson
10,240,302 B2 3/2019 Robinson
10,280,610 B1 5/2019 Robinson
10,280,611 B1 5/2019 Robinson
10,316,661 B2 6/2019 Hensley et al.
10,323,360 B2 6/2019 Robinson
10,323,407 B1 6/2019 Robinson
10,323,408 B1 6/2019 Robinson
10,323,409 B1 6/2019 Robinson
10,352,003 B2 7/2019 Robinson
10,352,039 B2 7/2019 Robinson
10,358,777 B2 7/2019 Robinson
10,358,813 B2 7/2019 Robinson
10,385,518 B2 8/2019 Robinson
10,385,565 B2 8/2019 Robinson
10,407,901 B2 9/2019 Robinson
10,422,127 B2 9/2019 Hensley et al.
10,480,136 B2 11/2019 Robinson
10,480,654 B2 11/2019 Robinson
10,519,651 B2 12/2019 Hensley et al.
10,533,315 B2 1/2020 Robinson
10,533,316 B1 1/2020 Robinson
2006/0117692 A1 * 6/2006 Trout ..... E04B 1/6812 52/393
2014/0219719 A1 8/2014 Hensley et al.
2014/0360118 A1 12/2014 Hensley et al.
2015/0068139 A1 3/2015 Witherspoon
2017/0130450 A1 5/2017 Witherspoon
2017/0159817 A1 6/2017 Robinson
2017/0191256 A1 7/2017 Robinson
2017/0226733 A1 8/2017 Hensley et al.
2017/0241132 A1 8/2017 Witherspoon
2017/0254027 A1 9/2017 Robinson
2017/0268222 A1 9/2017 Witherspoon et al.
2017/0292262 A1 10/2017 Hensley et al.
2017/0298618 A1 10/2017 Hensley et al.
2017/0314213 A1 11/2017 Robinson
2017/0314258 A1 11/2017 Robinson
2017/0342665 A1 11/2017 Robinson
2017/0342708 A1 11/2017 Hensley et al.
2017/0370094 A1 12/2017 Robinson
2018/0002868 A1 1/2018 Robinson
2018/0016784 A1 1/2018 Hensley et al.
2018/0038095 A1 2/2018 Robinson
2018/0106001 A1 4/2018 Robinison
2018/0106032 A1 4/2018 Robinison
2018/0112363 A1 * 4/2018 Bradford ..... E01D 19/062
2018/0119366 A1 5/2018 Robinison
2018/0142465 A1 5/2018 Robinison
2018/0148922 A1 5/2018 Robinison
2018/0163394 A1 6/2018 Robinison
2018/0171564 A1 6/2018 Robinison
2018/0171625 A1 6/2018 Robinison
2018/0202148 A1 7/2018 Hensley et al.
2018/0238048 A1 8/2018 Robinison
2018/0266103 A1 9/2018 Robinson
2018/0274228 A1 9/2018 Robinson
2018/0300490 A1 10/2018 Robinson
2018/0363292 A1 12/2018 Robinson
2018/0371746 A1 12/2018 Hensley et al.
2018/0371747 A1 12/2018 Hensley et al.
2019/0057215 A1 2/2019 Robinson
2019/0063608 A1 2/2019 Robinson et al.
2019/0071824 A1 3/2019 Robinson
2019/0107201 A1 4/2019 Robinson
2019/0108351 A1 4/2019 Robinson
2019/0194880 A1 6/2019 Robinson
2019/0194935 A1 6/2019 Robinson
2019/0211546 A1 7/2019 Hensley et al.
2019/0242070 A1 8/2019 Robinson
2019/0242117 A1 8/2019 Robinson
2019/0242118 A1 8/2019 Robinson
2019/0249420 A1 8/2019 Robinson
2019/0249421 A1 8/2019 Robinson
2019/0249422 A1 8/2019 Robinson
2019/0249423 A1 8/2019 Robinson
2019/0266335 A1 8/2019 Robinson
2019/0271150 A1 9/2019 Robinson
2019/0271151 A1 9/2019 Robinson
2019/0323347 A1 10/2019 Hensley et al.
2020/0018061 A1 1/2020 Robinson

* cited by examiner

DURABLE JOINT SEAL SYSTEM WITH FLEXIBLY ATTACHED COVER PLATE AND RIB

CROSS-REFERENCE TO RELATED APPLICATIONS

This application is a continuation in part of U.S. patent application Ser. No. 15/846,387, filed Dec. 19, 2017, which is incorporated herein by reference, which is a continuation in part of U.S. patent application Ser. No. 15/702,211 filed Sep. 12, 2017, which is incorporated herein by reference, and which issued Mar. 29, 2019 as U.S. Pat. No. 10,240,302, the benefit of and the priority to which are hereby claimed, which is a continuation-in-part of U.S. patent application Ser. No. 15/649,927 for "Expansion Joint Seal for Surface Contact Applications," filed Jul. 14, 2017, which is incorporated herein by reference, and which issued Dec. 12, 2017 as U.S. Pat. No. 9,840,814, the benefit of and the priority to which are hereby claimed, which is a continuation of U.S. patent application Ser. No. 15/062,354 for "Expansion Joint Seal for Surface Contact Applications," filed Mar. 7, 2016, which is incorporated herein by reference, and which issued Sep. 19, 2017 as U.S. Pat. No. 9,765,486 the benefit of and the priority to which are hereby claimed.

STATEMENT REGARDING FEDERALLY SPONSORED RESEARCH OR DEVELOPMENT

Not Applicable.

BACKGROUND

Field

The present disclosure relates generally to systems for creating a durable seal between adjacent panels, including those which may be subject to temperature expansion and contraction or mechanical shear. More particularly, the present disclosure is directed to an expansion joint design for use in surfaces exposed to impact or transfer loads such as foot or vehicular traffic areas.

Description of the Related Art

Construction panels come in many different sizes and shapes and may be used for various purposes, including roadways, sideways, and pre-cast structures, particularly buildings. Historically, these have been formed in place. Use of precast concrete panels for floors, however, has become more prevalent. Whether formed in place or by use of precast panels, designs generally require forming a lateral gap or joint between adjacent panels to allow for independent movement, such in response to ambient temperature variations within standard operating ranges, building settling or shrinkage and seismic activity. Moreover, these joints are subject to damage over time. Most damage is from vandalism, wear, environmental factors and when the joint movement is greater, the seal may become inflexible, fragile or experience cohesive and/or adhesive failure. As a result, "long lasting" in the industry refers to a joint likely to be usable for a period greater than the typical lifespan of five (5) years. Various seals have been created in the field. Moreover, where in a horizontal surface exposed to wear, such as a roadway or walkway, it is often desirable to ensure that contaminants are retarded from contacting the seal and that the joint does not present a tripping hazard, whether as a result of a joint seal system which extends above the adjacent substrates or as a result of positioning the joint seal system below the surface of the substrates. This may be particularly difficult to address as the size of the expansion joint increases.

Various seal systems and configurations have been developed for imposition between these panels to provide seals or expansion joints to provide one or more of fire protection, waterproofing, sound and air insulation. This typically is accomplished with a seal created by imposition of multiple constituents in the joint, such as silicone application, backer bars, and elastically-compressible cores, such as of foam. While such foams may take a compression set, limiting the capability to return to the maximum original uncompressed dimension, such foams do permit compression and some return toward to the maximum original uncompressed dimension.

Expansion joint seal system designs for situations requiring the support of transfer loads have often required the use of rigid extruded rubber or polymer glands. These systems lack the resiliency and seismic movement required in expansion joints. These systems have been further limited from desirably functioning as a fire-resistant barrier.

Other systems have incorporated cover plates that span the joint itself, often anchored to the concrete or attached to the expansion joint material and which are expensive to supply and install. These systems sometimes require potentially undesirable mechanical attachment, which requires drilling into the deck or joint substrate. Cover plate systems that are not mechanically attached rely on support or attachment to the expansion joint, thereby subjecting the expansion joint seal system to continuous compression, expansion and tension on the bond line when force is applied to the cover plate, which shortens the life of the joint seal system. Some of these systems use an elastically-compressible core of foam to provide sealing, i.e. a foam which may be compressed by has sufficient elasticity to expand as the external force is removed until reaching a maximum expansion. But these elastically-compressible core systems can take on a compression set when the joint seal system is repeatedly exposed to lateral forces from a single direction, such as a roadway. This becomes more pronounced as these elastically-compressible core systems utilize a single or continuous spine along the length of the expansion joint seal system—which propagates any deflection along the length. The problems and limitations of the current elastically-compressible core sealing cover plate systems that rely on a continuous spline are well known in the art.

These cover plate systems are designed to address lateral movement—the expansion and compression of adjacent panels. Unfortunately, these do no properly address vertical shifts—where the substrates become misaligned when the end of one shifts vertically relative to the other or longitudinal shifts between panels. In such situations, the components attached to the cover plate are likewise rotated or elevated in space causing a pedestrian or vehicular hazard. The current systems do not adequately address the differences in the coefficient of linear expansion between the cover plate and the substrate or allow for curved joint designs. The inability of the current art to compensate for the lateral or thermal movement of the cover plate results in failure of attachment to the cover plate or additional pressure being imposed on one half of the expansion joint system and potentially pulling the expansion joint system away from the lower substrate. Current systems do not sufficiently address the potential impact or shock to the cover plate from vehicular traffic over time or by a snowplow or other.

SUMMARY

The present disclosure therefore meets the above needs and overcomes one or more deficiencies in the prior art by providing an expansion joint system which includes a cover plate, a plurality of ribs, an elastically-compressible core having a core bottom surface, and a core top surface, wherein each of the plurality of ribs pierces the elastically-compressible core at the core top surface, and a flexible member attached to the cover plate and to each of the plurality of ribs, wherein at least one of the plurality of ribs remains rotatable in relation to the cover plate.

The disclosure also provides an expansion joint seal which includes a cover plate, a rib, an elastically-compressible core having a first layer and a second layer, the rib between the first layer elastically-compressible core and the second layer core, and a flexible member attached to the cover plate and to the, wherein the rib remains rotatable in relation to the cover plate.

The disclosure also provides an expansion joint seal including a cover plate, arib, an elastically-compressible core having a core bottom surface, and a core top surface, the extending through the elastically-compressible core at the core top surface, the rib extending to the core bottom surface, and a flexible member attached to the cover plate and to the rib, wherein the rib remains rotatable in relation to the cover plate.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

Figure 1:
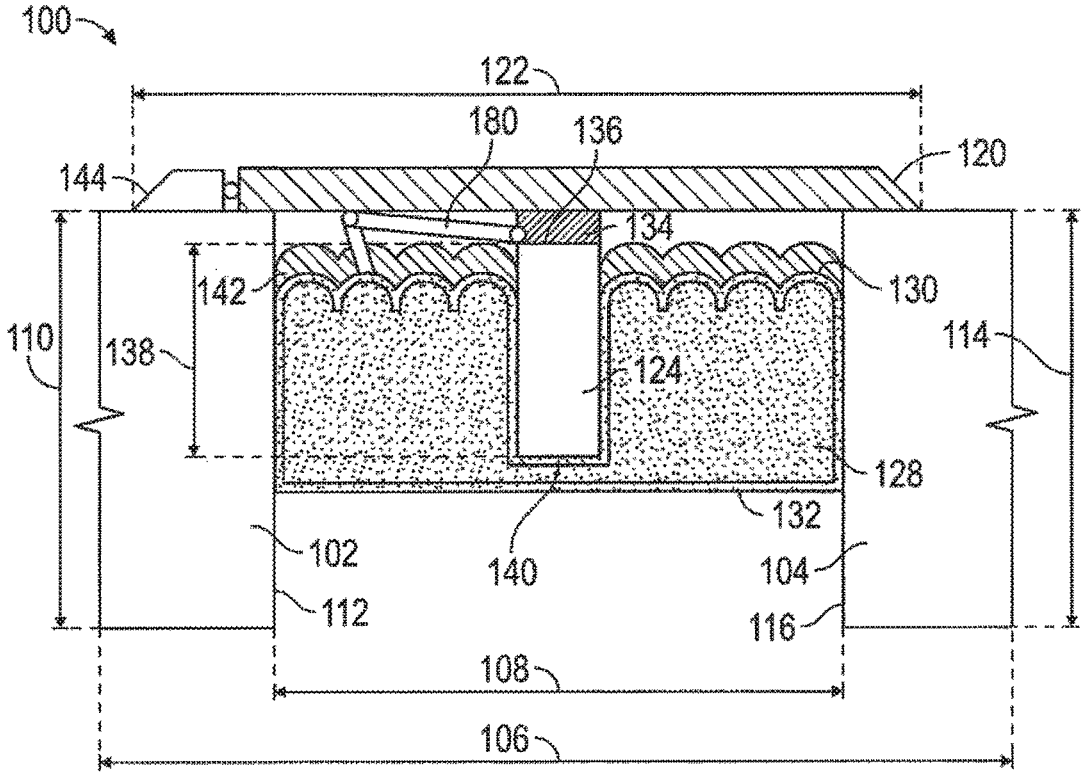
FIG. 1 provides an end view of one embodiment of the present disclosure.

An expansion joint seal system 100 is provided for imposition in a joint, such that a portion remains above the joint, i.e. partial imposition. The joint is formed of a first substrate 102 and a second substrate 104, which are each substantially co-planar with a first plane 106. The joint is formed as the first substrate 102 is separated, or distant, the second substrate 104 by a first distance 108. The first substrate 102 has a first substrate thickness 110, and has a first substrate end face 112 substantially perpendicular to the first plane 106. Likewise, the second substrate 104 has a second substrate thickness 114, and has a second substrate end face 116 substantially perpendicular to the first plane 106.

By selection of the properties of its various elements, the expansion joint seal system 100 may provide sufficient fire endurance and movement to obtain at least the minimum certification under fire rating standards. The selection of fire retardant components permits protection sufficient to pass a building code fire endurance protection, such as for one hour under ASTM E 1399 requiring pre-test cycling or EN 1366 with joint cycling during the fire endurance testing. Moreover, the expansion joint system 100 may reduce the damage from impact of external components.

Referring to FIG. 1, an end view of one embodiment of the expansion joint seal system 100 of the present disclosure installed in a horizontal joint is provided. The expansion joint seal system 100 preferably includes a cover plate, a plurality of ribs 124, an elastically-compressible core 128, which may be a body of a resilient compressible foam sealant, and a flexible member 134 attached to the cover plate 120 and to each of the plurality of ribs 124.

Figure 2:
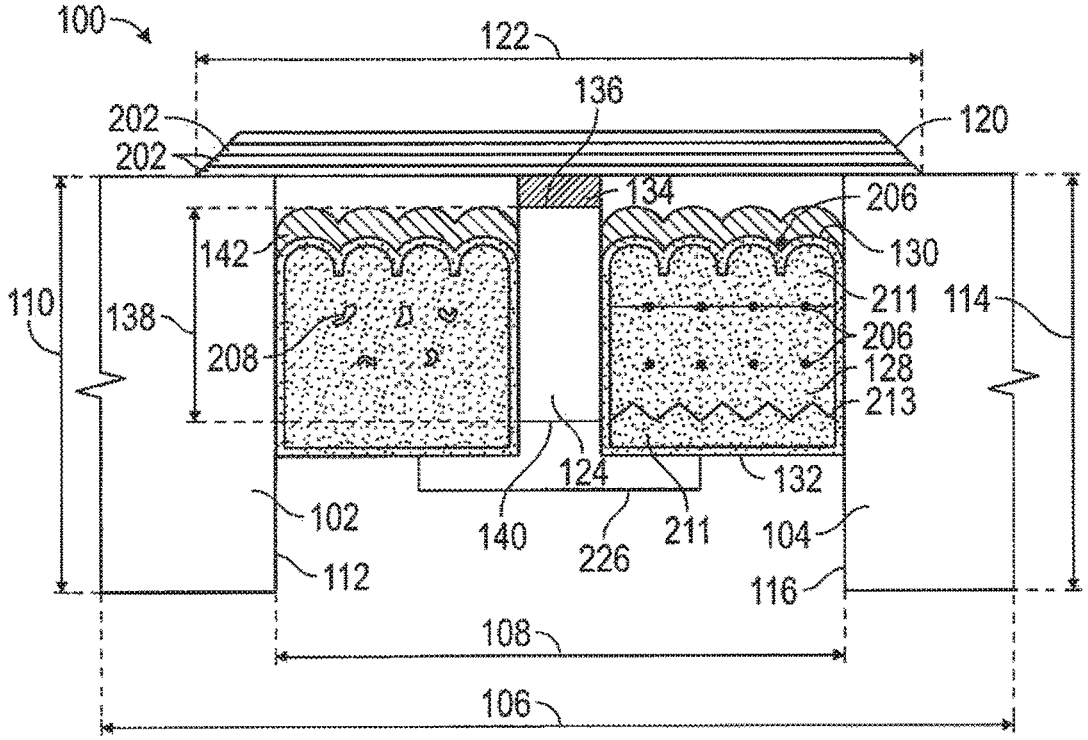
FIG. 2 provides an end view of an embodiment of the present disclosure.

The cover plate 120 is preferably made of a material sufficiently resilient to sustain and be generally undamaged by the surface traffic atop it for a period of at least five (5) years and of a material and thickness sufficient to transfer any loads to the substrates which it contacts and may have limited compressibility. The cover plate 120 may be provided to present a solid, generally impermeable surface, or may be provided to present a permeable surface. The cover plate 120 has a cover plate width 122. To perform its function when positioned atop the expansion joint, and to provide a working surface, the cover plate width 122 typically is greater than the first distance 108. In some cases, it may be beneficial for a hinged ramp 144 to be attached to the edge of the cover plate 120. A ramp 144, hingedly attached to the cover plate 120 may provide a surface adjustment should the substrates 102, 104 become unequal in vertical position, such as if one substrate is lifted upward. A ramp 144 ensures that a usable surface is retained, even when the substrates 102, 104 cease to be co-planer, from the first substrate 102, to the cover plate 102, through to the second substrate 102. In the absence of such a ramp 144, movement of one substrate would result in the edge of the cover plate 102 being rotated upward—presenting a hazard to vehicular and pedestrian traffic. Alternatively, rather than being positioned atop the expansion joint, the cover plate 120 may be less than the first distance 108 and installed flush or below the top of substrate 102 and/or installed flush or below the surface of substrate 104. The contact point for cover plate 120 may be the deck or wall substrate or may be a polymer or elastomeric material to reduce wear and to facilitate the movement function of the cover plate 120. Regardless of the intended position, the cover plate 120 may be constructed without restriction as to its profile. The cover plate 120 may be constructed of a single plate as illustrated in FIG. 1. The cover plate 120 may be constructed of multiple cover plate layers 202, as illustrated in FIG. 2, providing a wear surface 203 on its top, which may be removable, and enabling repair or replacements of wear surfaces without replacing the entire cover plate 120 or replacing the elastically-compressible core 128. Multiple layers 202 may be advantageous in environments wherein the cover plate will be subjected to strikes, such as by a snow plow or where the material of cover plate 120 may suffer from environmental exposure, such as in desert conditions. Each layer 202 is selected from a durable material which may be bonded or adhered to an adjacent layer 202, but which may be separated by the adjacent layer 202 upon the desired minimum lateral force. Where the cover plate 120 has a plurality of layers 202, there may be a water-permeable wear surface atop the bottom layer. The cover plate 120 may also be sized for imposition into a concrete or polymer nosing, allowing for a generally-flat surface for snow plowing. The cover plate 120 may be affixed to the first substrate 102 and/or the second substrate 104 at the substrates surface or any point below. When desired, the cover plate 120 may be eliminated, together with attached components.

Figure 3A:
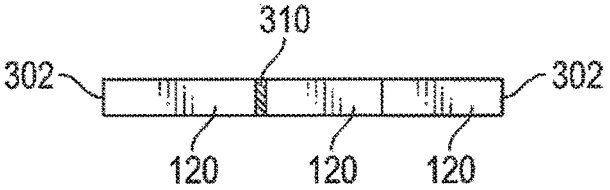
FIG. 3A provides a top view of one embodiment of the cover plate.
Figure 3B:
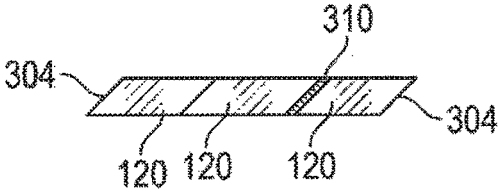
FIG. 3B provides a top view of another embodiment of the cover plate.
Figure 3C:
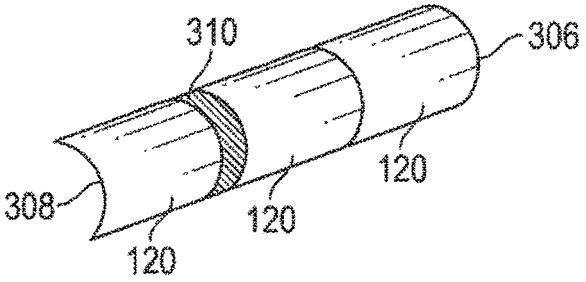
FIG. 3C provides a top view of a further embodiment of the cover plate.
Figure 3D:
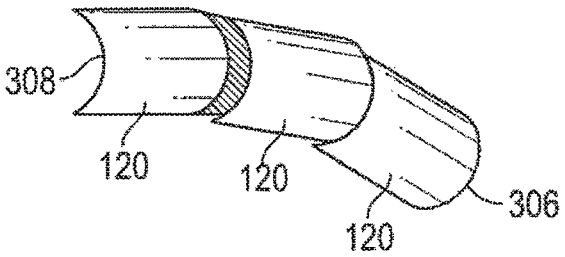
FIG. 3D provides a top view of an additional embodiment of the cover plate.

Referring to FIG. 3A, a plurality of openings 312 may be provided through the cover plate 120 or through the underlying cover plate layers 202. These openings may be sized sufficiently small to permit water penetration or drainage, or sized sufficiently large to permit access to components within the joint to permit joint inspection or even repair without detachment. A wear surface 203 may cover these openings 312 and may be selected for permeability to limit communication through the cover plate 120.

Figure 4:
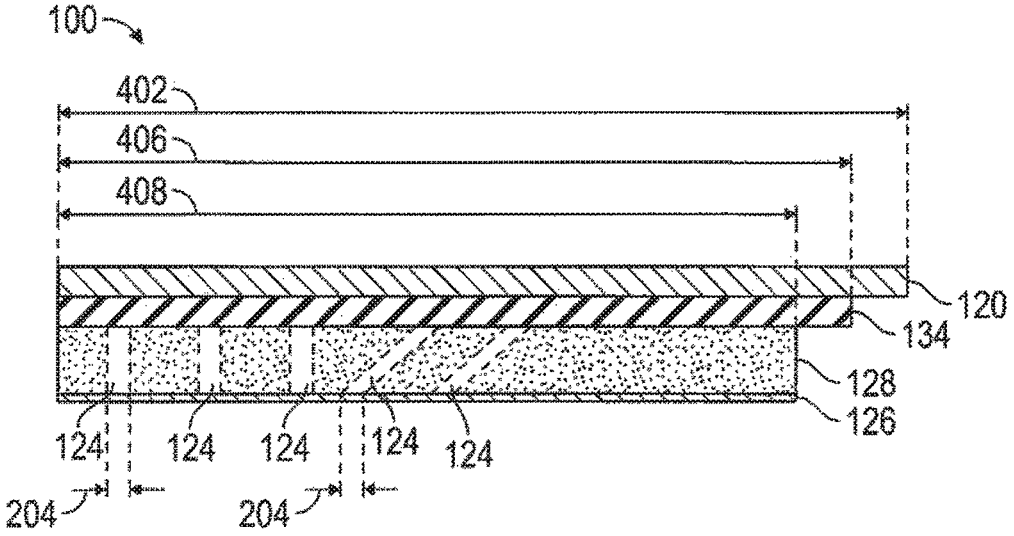
FIG. 4 provides a side view of one embodiment of the present disclosure.

As illustrated in FIGS. 3A, 3B, 3C and 3D, which provide top views of several embodiments of the cover plate 120, the cover plate 120 may present a rectangular shape with a square end 302 as provided in FIG. 3A. The cover plate 120 may instead present an angled end 304 as provided in FIG. 3B. This angled end 304 may be at more than an angle of 90 degrees. The angled end 304 is beneficial where the cover plate 120 may expand in response to temperature variations. Rather than buckling upward like a conventional, square-ended cover plates 120, the angled end 304 causes the cover plate 120 to be rotated with respect to the joint. The rotation is impeded, and reversed after cooling, by the plurality of ribs 124 and the elastically-compressible core 128. As provided in FIGS. 3C and 3D, the cover plate 120 may present a first curved end 306 and a second complementary curved end 308, each with the same radius. The curved ends 306 and 308 thus abut at least in part over a range of respective angles, permitting use of a cover plate 120 without gapping along straight and curved joints. As the radius of the curved joint decreases, the cover plate length 402, as illustrated in FIG. 4, will be accordingly reduced to permit operation. Shorter cover plate lengths 402 may be used to provide segmented lengths to allow for less damage and curves during thermal expansion. Use of cover plates 120 with angled end 304 or curved ends 306 and 308 permits each cover plate 120 to move without opening a continuous gap in the direction of traffic.

Where a plurality of cover plates 120 are used, such as depicted in FIGS. 3A-3D, the cover plate 120 may be rotatably associated with the elastically-compressible core 128 to permit rotation of the cover plate 120 so it may be positioned nearly perpendicular to the expansion joint and substates 102, 104. Where the cover plate 120 is rotatable with respect to the elastically-compressible core 128, particularly with a single point of connection, the cover plate 120 may initially provide a support for the expansion joint seal system 100 when installed in the expansion joint by rotation of the cover plate 120 by 90 degrees to span the expansion joint while permitting clear observation of the components below, providing support from above, such as that provided by convention supports—which are additional components to be maintained and detached after use. In the present invention, when installation is deemed complete, the cover plate 120 may be rotated some ninety degrees to reside atop the elastically-compressible core 128.

Referring to FIG. 2, an end view of an embodiment of the expansion joint seal system 100 of the present disclosure installed in a horizontal joint is provided. The expansion joint seal system 100 may further include a force transfer plate 226 to which one or more of the ribs 124 may be flexibly and/or rotatably attached at the end opposing the flexible member 134. Some or all of the ribs 124 may be fixedly attached to the force transfer plate 226 or may be pivotally attached so as to permit one or two degrees of freedom. Each rib 124 may have a profile intended to facilitate its function, such as a paddle shape or a dual paddle or spike shape. Where attached, the rib 124 may be detachably attached to the force transfer plate 226. The force transfer plate 226 may be tapered or notched, or otherwise provided, to bend and/or break in a seismic event to prevent damage to the substrates 102, 104. The force transfer plate 226 has a force transfer plate length 406, which is equivalent in length to the cover plate length 402 and the force transfer plate length 406 being equivalent. Similarly, the core length 408 may be equivalent to the cover plate length 402. The force transfer plate 226 need not be rigid or continuous and can be connected to ribs 124 in a fixed, hinged or multi-axis rotational connection. A flexible force transfer plate 226 permits the use of the expansion joint seal system 100 in joints which are not straight. The force transfer plate 226 may retard the movement of some or each rib 124, but also, by virtue of its connection to the elastically-compressible core 128, may provide support to the ribs 124 from below.

The force transfer plate 226 need not retard the movement of each rib 124 as the movement of each rib 124 will be retarded by the elastically-compressible core 128. Flexible attachment of the ribs to the cover plate 120 and to the force transfer plate 226 permits multi-axis movement of the ribs 124 and the flexible member 134 in connection with cover plate 120. The flexible member 134 may be connected to the cover plate 120 with components intended to sever the connection upon a strike to the cover plate 120. This may be accomplished with breakaway shear pins connecting the flexible member 134 to either, or both of, the cover plate 120 and the ribs 124. The force transfer plate 226 may be composed, or contain, hydrophilic or fire-retardant or other compositions that would be obvious to one skilled in the art. In the event of a failure of the elastically-compressible core 128 to retard water or to inhibit water penetration, a hydrophilic or hydrophobic composition on the force transfer plate 226 may react to inhibit further inflow of water. Additionally, the force transfer plate 226 may contain or have an intumescing agent, so that upon exposure to high heat, the force transfer plate 226 may react, and provide protection to the expansion joint.

The force transfer plate 226 is maintained in position at least by attachment or contact with the elastically-compressible core 128. The force transfer plate 226 may be positioned so as to contact and be adhered only to the core bottom surface 132 of the elastically-compressible core 128. Alternatively, the force transfer plate 226 may be positioned within the elastically-compressible core 128 so that the edges of the force transfer plate 226 may extend into the elastically-compressible core 128 and be supported from below by the body of an elastically-compressible core 128. Preferably, the force transfer plate 226 is positioned within the lowest quarter of the elastically-compressible core 128 for maximum load force absorption. The force transfer plate 226 may be positioned higher in the elastically-compressible core 128 in lighter duty or pedestrian applications.

The force transfer plate 226 does not attach to either of the substrates 102, 104 and is maintained in position by connection to the body of an elastically-compressible core 128. The force transfer plate 226 may contact one or more points on the substrate to provide compression resistance and/or support from below for the elastically-compressible core 128, the ribs 124, the flexible member 134 and the cover plate 120. The force transfer plate 226 may provide high impact recovery force. The force transfer plate 226 may provide support from below for the ribs 124 which are not otherwise supported from below by the body of an elastically-compressible core 128. Beneficially, the force transfer plate 226 maintains the each of the ribs 124 in position whether the ribs 124 have support from below or not. In high cover plate shear conditions, the force transfer plate 226 supports a joint system which is wider or which uses a narrow depth, and uses the resistance to compression to retard each of the ribs 124 from shifting and delivering all of the compressive force to the trailing edge side of the expansion joint seal system 100. This reduces the ultimate force and the amount of compression by applying the compressive force over a larger area of the elastic-compressible core 128 and at a 90-degree angle to the direct compressive force which adds longevity to the useful life compared to the prior art. The force transfer plate 226 may provide upward support to the elastically-compressible core 128.

Figure 7:
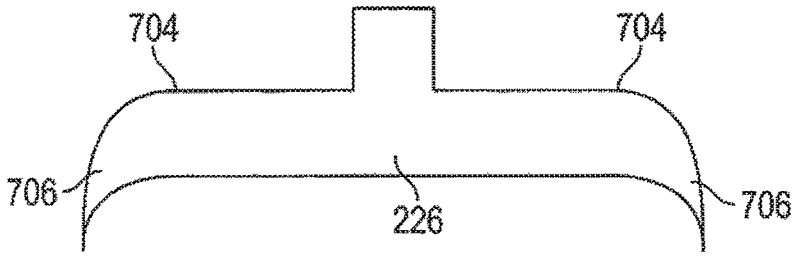
FIG. 7 provides an end view of one embodiment of the force transfer plate.

Preferably, the force transfer plate 226 is sufficiently wide to maximize load transfer. The force transfer plate 226 can be up to or greater than 50% of the width of the expansion joint in seismic applications requiring +/−50% movement. A flexible force transfer plate 226 may be used for contact with the substrate or when expected movement is greater than +/−50%. Referring to FIG. 7, the force transfer plate 226 may include downwardly curving hook-like appendages 706, which may be rigid or flexible, at the lateral ends of the bottom of the force transfer plate 226 to aid in retarding downward movement of the joint system 100 in the joint and contact of the joint system 100 with the bottom of the joint. The force transfer plate may include at least one pointed downwardly depending extension, the appendage 706, from a bottom of the force transfer plate 226. These may include pre-grooved break or bend points 704 designed to fail in a seismic event, to avoid restricting the joint from closing and damaging the substrate. It can further be an advantage to use a light weight polymer or other material that will support the force transfer plate 226 horizontally and tend to return the ribs 124 back to center after traffic force is removed. When the cover plate 120 is omitted from an expansion joint system, the force transfer plate 226 may be optionally omitted.

As provided in FIGS. 3A, 3B, 3C, and 3D, a compressible spacer 310, which may be elastically-compressible or sliding material, may be provided at the end of a cover plate 120 or between adjacent cover plates 120. The compressible spacer 310 may be an elastomer which may be attached to the end of the cover plate 120 configured to the match the profile of the cover plate end. As a result, each cover plate 120 is insulated from the adjacent cover plate 120 and any forces applied to it. The cover plate connection can be a notched or over lapping connection providing the appearance of continuous cover plate. A compressible spacer 310 can be combined with the notched or overlapping ends of cover plate 120. Beneficially, the cover plate 120 may therefore experience thermal expansion and external impacts without unacceptable damage to the plurality of ribs 124 or the body of an elastically-compressible core 128 or to adjacent systems 100. Additionally, use of an angular end 304 or curved end 306, 308 provides a surface with reduced potential to trip or catch. Moreover, the cover plate 120 may be provided to overlap an adjacent cover plate 120, such as by a notched, sawtooth or lap joint, such as that the cover plates 120 provide continuous joint protection and allow for thermal expansion.

Referring to FIG. 4, a side view of one embodiment of the present disclosure is provided. The cover plate 120 has cover plate length 402, which is at least as great as the length 406 of the flexible member 134. The elastically-compressible core 128 likewise has a length 408 which is less than the cover plate length 402. Preferably, the cover plate 120, the elastically-compressible core 128, and the force transfer plate 226 are equivalent in length. Because the ribs 124 need not have substantial length to perform, the sum of the rib length 404 of each of the ribs 124 may be less than one half the cover plate length 402, though the relationship may be altered by shorter or longer ribs 124. There is therefore an appreciable distance between each rib 124. The ribs 124 may be oriented in any direction from the flexible member 134 and may be parallel to one another or may be at angles to one another, such as a continuous common orientation or in an alternating sequence of differing angles to one another. Alternatively, at least one of the plurality of ribs 124 may be non-parallel to at least another one of the plurality of ribs 124. Typically, these will descend directly downward from the cover plate 120 but may be angled as desired along a longitudinal axis 210 of the cover plate 120. When the cover plate 120 is omitted from an expansion joint system, the ribs 124 would likewise be omitted.

Referring to FIGS. 1, 2, 5, 6 and 8, the flexible member 134 can be removable from the cover plate 120 at the underside of the cover plate 120 and may be flexible or rotatable. The point of attachment may be in the middle of the cover plate 120 but may be offset from the centerline of the cover plate 120. The flexible member 134 may be of any resilient structure which permits angular rotation of the ribs 124 known in the art. The flexible member 134 may be, for example, a hinge, or may be a short rigid member with a hinge at the end for attachment to the cover plate 120 and at the end for attachment to the rib 124 or may be a member with its own spring force, such as steel, or a high durometer rubber, or carbon fiber. The flexible member 134 may be a pivot joint retained at locations along the cover plate 120, such as a conventional hinge or a flexible connector. The flexible member 124 may include a first hinged connector, a second hinged connector and a connecting member intermediate the first hinged connector and the second hinged connector. The flexible member 134 may also provide a lower strength of attachment one of the cover plate 120 and the ribs 124, such that a substantial impact to the cover plate 120 results in the separation and loss of the cover plate 120 without the balance of the system 100 being torn from the joint. When the cover plate 120 is omitted from an expansion joint system 100, the flexible member 134 may likewise be omitted. When desired, the flexible member 120 may be omitted, and the cover plate 120 directly attached to the ribs 124.

Referring to FIGS. 1, 2, 4, 5, 6, 8, 9 and 10, the expansion joint system 100 is presented as imposed in a horizontal joint with the cover plate 100 in the same plane. The cover plate 100 however, need not be in the same plane as the elastically-compressible core 128. In some instances, such as in a stairway, it may be advantageous for the cover plate 120 to be in a vertical plane, while the elastically-compressible core 128 may be in the horizontal plane as depicted in FIGS. 1, 2, 4, 5, 6, 8, 9 and 10 or in a vertical plane.

Figure 5:
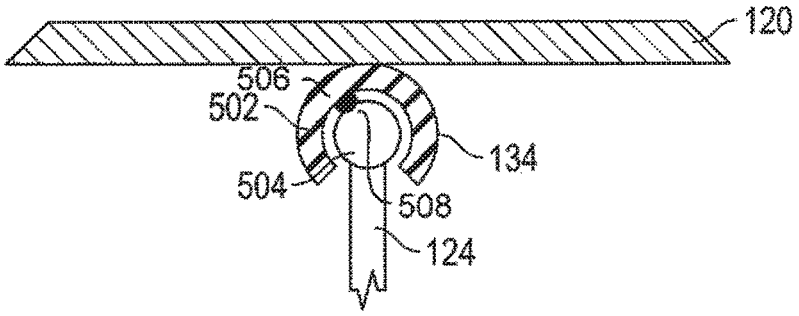
FIG. 5 provides an end view of a flexible member for an embodiment of the present disclosure.

Alternatively, as depicted in FIG. 5, the flexible member 134 may be constructed with an interlocked partial open cylinder, or first member 502, and an encircled cylindrical second member 504. The flexible member 134 may thus have a cylindrical second member 504 and a partial open cylinder first member 502, such that the partial open cylinder first member 502 interlocks about and partially encircles the cylindrical second member 504. The partial open cylinder first member 502 may provide a smooth surface, may include a ball detent 506 (or detent 508), or may include other temporary or permanent locking mechanisms. The cylindrical second member 504 may likewise provide a smooth surface, may include a detent 508 (or ball detent 506), or may include other temporary or permanent positioning mechanisms. When a ball detent, ratcheting or other temporary or permanent locking mechanism is provided, the free rotation of the ribs 124 can be limited or estopped. The detent 508, for example, may be a channel rather than a spherical shape, limiting the rotation of the ribs 124. Alternatively, a plurality of detents 508 may be imposed in the surface of the partial open cylinder first member 502, limiting the change in position of the ribs 124 from association with one detent 508 to another detent 508. Beneficially, the ball detent 506 permits the ribs 124 to cycle back to an earlier position. When cycling of the position of the ribs 124—from a first position, to a second position, and back to a first position—is undesirable, alternative systems, such as a pawl and ratchet, may be provided, such that when the force is sufficient to move the rib 124 to a second position, a pawl on the face of one of the partial open cylinder first member 502 and the cylindrical second member 504 engaged a ratchet and is thereafter constrained from returning to the first position absent user intervention. The ball detent 506, or ratcheting system, or other system may include a release mechanism to return the rib 124 to the original position, such as release of a set screw. The temporary or permanent positioning mechanisms may provide resistance, or a controlled resistance, or limited rotation which may be locked into position. Such positioning may be desirable in cases of a compression set in the elastically-compressible core 128 or a failure of the elasticity of the elastically-compressible core 128. By selection of the sizing of components, such as the spring force on the ball detent, the depth of the detent, and the size of the pawl, the force necessary to reposition in the rib 124 may be controlled. Beneficially, the ribs may be independent of one another or be linked together, such that in the first circumstance the temporary or permanent positioning mechanism may provide localized positioning of each rib 124 in response to the particular performance and forces surrounding it. The ribs 124 may alternatively be pre-positioned in the the temporary or permanent positioning mechanism, including positioning ribs 124 on alternating sides of the cover plate 120, which may be beneficial in opposing compression forces from each side. To reduce the potential for a rib 124 to tear through the elastically-compressible core 128 rather that reposition in the temporary or permanent positioning mechanism, the ribs 124 may have a paddle-like profile. Likewise, the temporary or permanent positioning mechanism may include an external release, through the cover plate 120, intended to permit repositioning of the ribs 124 without removal of the cover plate 120.

Figure 6:
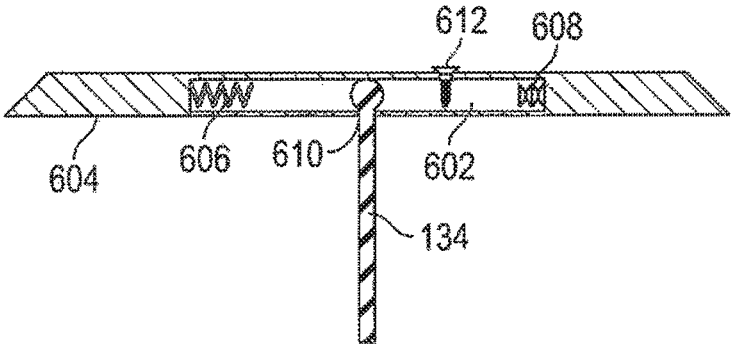
FIG. 6 provides an end view of an embodiment of the cover plate and flexible member.

Referring to FIG. 6, the flexible member 134 can be attached to the cover plate 120, via a closed elliptical slot 602 in the bottom 604 to allow for movement in the direction of impact, allow for access to the joint with the flexible member 134 attached to the cover plate 120. The cover plate 120 therefore may include the closed elliptical slot 602 in a cover plate bottom 604 and wherein the flexible member 134 is attached to the cover plate 120 at the closed elliptical slot 602. The slot 602 in the bottom 604 of the cover plate 120 may incorporate a force-dissipating device, such as a spring 606 or rubber shock absorption material 608, at an end of the closed elliptical slot 602 to reduce the force transferred from the cover plate and therefore to the elastically-compressible core 128. The damping force of the spring 606 or rubber shock absorption material 608, or the vertical position of the flexible member 134 with respect to the cover plate 120 may be adjusted using a set screw or other systems known in the art. The opening 610 in the bottom 604 which provides communication to the closed elliptical slot may be sized to permit and to limit lateral movement of the flexible member 134 with respect to the cover plate 604. The extent of movement may be limited by boundaries imposed from the top of the cover plate 604, such as a screw 612, which may even pierce the flexible member 134 to preclude any lateral movement. As can be appreciated, a cover plate 604 with a slot 602 and an opening 610 in its bottom may be used to capture the rib 124, with or without a flexible member 134, such that the rib 124 and any elastically compressible core 128 may move independent of the cover plate 604.

Figure 8:
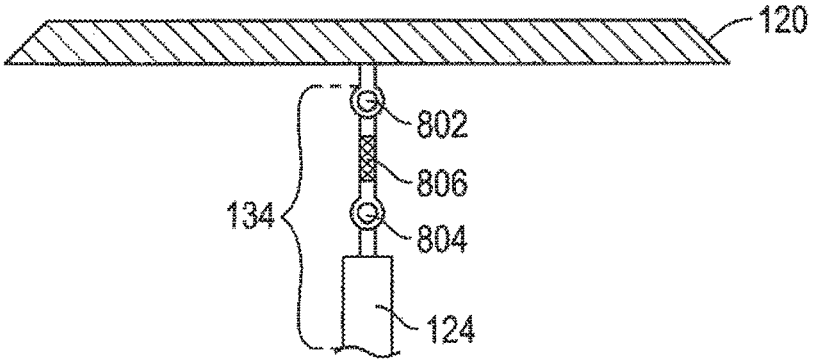
FIG. 8 provides an end view of a flexible member for an embodiment of the present disclosure.

Referring to FIG. 8, the flexible member 134 may comprise a first connector 802, a second connector 804, and connecting member 506. The connecting member 806 may be a rubber or flexible material that elongates under extreme force. Alternatively, the connecting member 806 may be flexible spring steel, which will flex or rotate, but not detach, from the cover plate 120. The first connector 802 may be a swivel connection, or other connection permitting some degree of freedom of motion, and the second connector 804 may likewise be a swivel connector, or other connection permitting some degree of freedom of motion, allowing for installation assistance, and preventing direct force from being transferred to the elastically-compressible core. This structure of the flexible member 134 may assist in retaining the cover plate 120 in place, while preventing the cover plate 120 from becoming offset with respect to the joint. Additionally, this structure of the flexible member 134 reduces the force applied to the cover plate 120 from being transmitted entirely through to the elastically-compressible core 128, extending the lifespan of the body of an elastically-compressible core 128 while reducing the direct force to the ribs 124 and the elastically-compressible core 128.

Referring to FIGS. 1, 2, 5, 6, and 8, the flexible member 134 is preferably detachable from the cover plate 120, such that the cover plate may be installed separately and may be removed for access and maintenance of the other components. Any system of attachment may be used, such as screws or bolts, as well as a keyed member to lock the cover plate 120 to the flexible member 134 when rotated one direction and to unlock the cover plate 120 from the flexible member 134 when rotated back to an original position. A keyed member reduces the potential for modification or vandalism as the tools for removal of the cover plate 120 are not readily available.

The cover plate 120 may be detachably attached to the flexible member 134. Expansion joint seals are often installed under conditions where mechanical strikes against the cover plate 120 are likely, such as roadways in locales which use snow plows. When used, snow plows employ a blade positioned at the roadway surface to scrape snow and ice from the roadway for removal. Any objects which extend above the roadway surface sufficient to contact the plow are likely to ripped from the roadway surface. It may therefore be preferable for the cover plate 120 to be detachably attached magnetically to the flexible member 134 and retained with a tether 180 to prevent the cover plate 120 from falling into the joint between the substrates 102, 104. This embodiment permits snow plow strikes on the cover plate 120 without permanent damage to the elastically-compressible core 128 or the balance of the expansion joint seal system 100. The tether 180, which may be also attached to the elastically-compressible core 128, may further prevent the elastically-compressible core 128 from sagging away from the cover plate 120, a problem known in the prior art. The tether 180 may be highly flexible, resilient material sufficient to sustain the impact load and sufficiently durable to do so the life of the joint system 100. The support of the elastically-compressible core 128 is of particular (or increased) importance where the elastically-compressible core 128 is in a width to depth ratio of 1:1 or less. Alternatively, the cover plate 120 may be detachably attached to the flexible member 134 using screws, bolts or other devices prepared to break-away in the event of a strike. The flexible member 134 may also be constructed to break apart in the event of a strike, such that flexible member has a tensile strength not in excess of 344.7 kPa. Where the flexible member 124 is provided as a hinge, the first member 302 of the flexible member 124 may be constructed of a high strength polymer, but which is still weaker than the associated second member 304.

Referring to FIGS. 1, 2, 5, 6, and 8, each of the plurality of ribs 124 are attached to the flexible member 134. Rather than providing a solid spline as in the prior art, the present disclosure provides a plurality of members, the ribs 124, which move independent of one another and about which each is surrounded by the elastically-compressible core 128, rather than being located on either side of a spline. Therefore, each of the plurality of ribs 124 remains rotatable and moveable in relation to the cover plate 120. The elastically-compressible core 128 fills the distance between the ribs 124, tying each of the ribs 124 to the other ribs 124 and therefore to the cover plate 120. Each rib 124 has a rib top edge 136, a rib thickness 138, a rib bottom surface 140, and a rib length 404. The sum of the rib length 404 of each of the ribs 124 is not more than one half the plate length 402. Ribs 124 may be provided as cylindrical bodies or may provide a rectangular prism oriented along the longitudinal length of the system 100. The ribs 124 may be electrically conductive, may include a carbon fiber structure, and/or may include an intumescent component. There is therefore an appreciable distance between each rib 124. The rib thickness 138 is sufficiently less than both the first substrate thickness 110 and the second substrate thickness 114, that neither any rib 124 nor the elastically-compressible core 128 contacts the bottom of the expansion joint. Beneficially, each rib 124 moves within the elastically-compressible core 128 and therefore collectively absorb any force transmitted from the cover plate 120 and permit access to the elastically-compressible core 128 after installation, when needed. In rotation, each rib 124 transfers any rotational force introduced into the system 100 into the elastically-compressible core 128 which absorbs the force by its compressive recovery force. Alternatively, a rib 124, including a solid or ribbed spine, can be used with, or without, a force recovery member/membrane 1202 providing support from below.

Referring to FIGS. 1, 2, 3, and 4, to provide the seal against the faces 112, 116 of the first and second substrates, the expansion joint seal system 100 includes an elastically-compressible core 128, which may be a body of a resilient compressible foam sealant. The elastically-compressible core has a core length 408, as provided in FIG. 4, a core bottom surface 132, a core top surface 130, and an uncompressed core width greater than the first distance 108. The elastically-compressible core 128 may have a width greater at the core top surface 130 than the width of the elastically-compressible core at the core bottom surface 132. As a result, when the elastically-compressible core 128 is imposed between the two substrates 102, 104, the elastically-compressible core 128 is maintained in compression between the two substrates 102, 104 and, by virtue of its nature, inhibits the transmission of water or other contaminants further into the expansion joint. The elastically-compressible core 128 contacts the first substrate end face 112 and the second substrate end face 116, when imposed under compression between the first substrate 102 and the second substrate 104. An adhesive may be applied to the substrate end face 112 and the second substrate end face 116 or to the elastically-compressible core 128 to ensure a bond between the expansion joint seal system 100 and the substrates 102, 104. Over time, as the first distance 108 between the first substrate 102 and the second substrate 104 changes, such as during heating and during cooling, the elastically-compressible core 128 expands to fill the void of the expansion joint, or is compressed to fill the void of the expansion joint. Preferably, the elastically-compressible core 128 is a single body of foam, but may be a lamination of several layers, or the combination of several elements adhered together to provide desired mechanical and/or functional characteristics and may comprise multiple glands and/or rigid layers that collapse under seismic loads. The different layers may have different densities, such that a first body, intermediate the cover plate and a second body, may have a first density and a second body may have a second density, where the first density and the second density are different. The elastically-compressible core 128 may be of polyurethane foam and may be open celled foam or closed cell. A combination of open and closed cell foams may alternatively be used. Suitable densities for the elastically-compressible core 128 prior to compression range from 15 kg/m$^3$ to 300 kg/m$^3$, but preferably less than 200 kg/m$^3$. For example, the elastically-compressible core may have an uncompressed density of 50-300 kg/m$^3$. Generally, the core may have a compression ratio between 0.5:1 and 9.5.1:1, though compression ratios outside that range are permissible. When coupled with a compression ratio from about 1.5:1 to 9.5:1, such as the elastically-compressible core 128 is laterally compressed to between 10% and 85% of its original lateral width, the elastically-compressible core 128 possesses desirable movement capabilities and functional properties such as water and fire resistance. Increased support and recovery force can be achieved with compressible cores configured to provide a density, after installation between 750 kg/m$^3$ and 1500 kg/m$^3$. The elastically-compressible core can have different densities within the same core to allow for variable compression, recovery and other functions of the expansion joint. The elastically-compressible core 128 may have a functional surface impregnation such that the elastically-compressible core 128 has an internal density variation of not more 10%, such that the elastically-compressible core 128 is essentially homogenous and able to provide structural support.

When an elastically-compressible core 128 is produced from foam, the pore sizes are preferably 90-200 pores per linear inch, a measurement typically referenced as "pores per inch," and abbreviated as PPI. Such a value is desirable for low viscosity, under 220 Cp, minimally-filled, or those using nanofillers such as clay, aluminum trihydrate, and microspheres. As the PPI is decreased, the pore size is increased, permitting thicker or larger fillers. Where a higher viscosity impregnate and/or larger particle size functional fillers are used, and when a vapor-permeable elastically-compressible core is desired, a foam of 25-130 PPI is preferred.

The elastically-compressible core 128 may contain hydrophilic, hydrophobic, conductive, or fire-retardant compositions as impregnates, or as surface infusions, as vacuum infusion, as injections, full or partial, or combinations of them. Moreover, the elastically-compressible core 128 may be caused to contain near the core top surface 130, such as by impregnation or infusion, a sintering material, wherein the particles in the impregnate move past one another with minimal effort at ambient temperature, but form a solid upon heating. Once such sintering material is clay. Such a sintering impregnate would provide an increased overall insulation value and permit a lower density at installation that conventional foams while still having a fire endurance capacity of at least one hour, such as in connection with the UL 2079 fire endurance test. While the cell structure, particularly, but not solely, when compressed, of an elastically-compressible core 128 inhibits the flow of water, the presence of an inhibitant or a fire retardant may prove additionally beneficial. The fire retardant may be introduced as part of the foaming process, or by impregnating, coating, infusing, or laminating, or by a functional membrane.

The elastically-compressible core 128 may be treated with, or contain, liquid-based fire-retardant additives, by methods known in the art, such as infusion, impregnation and coating or solid fire retardants, such as intumescent rods. Such liquid-based fire-retardant additives may be solids provided in a liquid medium. These liquid mediums include mere mobile phases, such as a base of water or alcohol or any other medium which would suspend the fire-retardant material until introduced into or onto the foam and which is intended to dry or evaporate away from the core after introduction. Similarly, the fire-retardant materials may include metal hydroxides or other compounds known to release water or fire suppressing gases when heated. As can be appreciated, non-toxic gases are preferable as there may be persons present when the fire-retardant materials decomposes. The impregnation may therefore be at least one of a fire retardant and a water inhibitor.

In an infusion technique, the fire-retardant material is injected into the elastically-compressible core 128, whether by needles in a liquid medium or by simple imposition, after the elastically-compressible core 128 has solidified.

Alternatively, infusion may be accomplished by other methods to drive the fire retardant into the elastically-compressible core 128, including by compressing the elastically-compressible core 128 and permitting expansion in the presence of the fire-retardant material, resulting in suction within the elastically-compressible core 128 as the internal voids refill, and then permitting any medium, such as a binder, to evaporate or weep out.

As known in the art, impregnation includes introducing a compressed elastically-compressible core 128 to a fire retardant in a liquid medium, permitting the elastically-compressible core 128 to expand and thereby create suction as the internal voids re-expand, then compressing the elastically-compressible core 128 to expel the liquid medium so that a desired volume, less than maximum, is retained within the elastically-compressible core 128. Alternatively, an elastically-compressible core 128 may be impregnated by impregnating a generally non-elastic core with a flexible elastomer, acrylic, or other similar flowing material to impart elasticity.

Alternatively, a solid fire-retardant material may be introduced. Intumescent bodies or materials, such as graphite, may contact or be imposed within the elastically-compressible core 128. Referring to FIG. 2, these intumescent rods 206 may inserted into, or pressed into, or positioned atop, the elastically-compressible core 128, or may even be formed in situ, such as in a pre-cut void in the elastically compressible core. Further, intumescent caulking or compound may be injected into the elastically-compressible core, such as in an off-set pattern to provide discrete intumescent bodies 208 throughout the elastically-compressible core 128. An offset pattern, when used, reduces any limitation on movement of the elastically-compressible core 128, yet when subjected to sufficient heating provides a fire-resistant crust, likely at the remaining surface of the elastically-compressible core 128. Alternatively, when the elastically-compressible core 128 is composed of laminations 211, the intumescent rods 212 may be positioned laterally between the laminating layers. In the case of laminations, intumescent rods 212 may be provided with a springing shape, such as a zig-zag or sinusoidal shape, and positioned from edge (or near edge) to edge (or near edge), or from edge to rib 124, to provide an intumescent body 213 with an internal spring force, and the associated laminations 211 of the elastically-compressible core 128 formed to fit. The intumescent body 213 may thus contact the elastically-compressible core 128.

In a further alternative, well-known in the art, a solid fire-retardant material, such as neoprene, may be introduced to the constituents of the elastically-compressible core 128 before foaming. Neoprene does not suppress fire but rather is a synthetic rubber produced by polymerization of chloroprene which protects the elastically compressible core during the initial temperature rise and resists burning due to its high burn point of about 500° C. Small pieces of neoprene can be introduced into an elastically-compressible core 128 made of polyurethane prior to the foam forming. Polyurethane results from the mixing of a polyol and diisocyanate to form a stable long-chain molecule. The neoprene, or other fire-retardant material, can be introduced with these two liquids are combined, resulting in the fire-retardant material being suspended within and throughout the elastically-compressible core 128. The fire-retardant materials can be uniformly dispersed or concentrated in specific areas. Neoprene can further be used to protect the elastically-compressible core 128 through the early stages of a fire and serve as part of staged design where it protects until another fire retardant starts reaches its decomposition temperature. An elastically-compressible core 128 formed in this way can be used without the need for impregnation, infusion, or coating, but may have increased fire-retardant properties should it be so treated.

Other systems may alternatively be used to introduce a fire retardant, or any functional filler. These may be printed onto the elastically-compressible core 128 by a screen method, gravure process, pressure sensitive injection rollers or by computer numerical control equipment. The fire retardant or filler may be surface coated or injected. It can then be compressed by a platen or rollers to increase the depth or concentration/density.

When the elastically-compressible core 128 is selected from a low-density material, selective impregnation/infusion may be beneficial to control the volume applied at the location of application, such as at the exposed surface, ensuring consistent fire retardancy, waterproofing and other functions and at levels equivalent to that otherwise achieved at higher densities/compression ratios known in the art.

Figure 12:
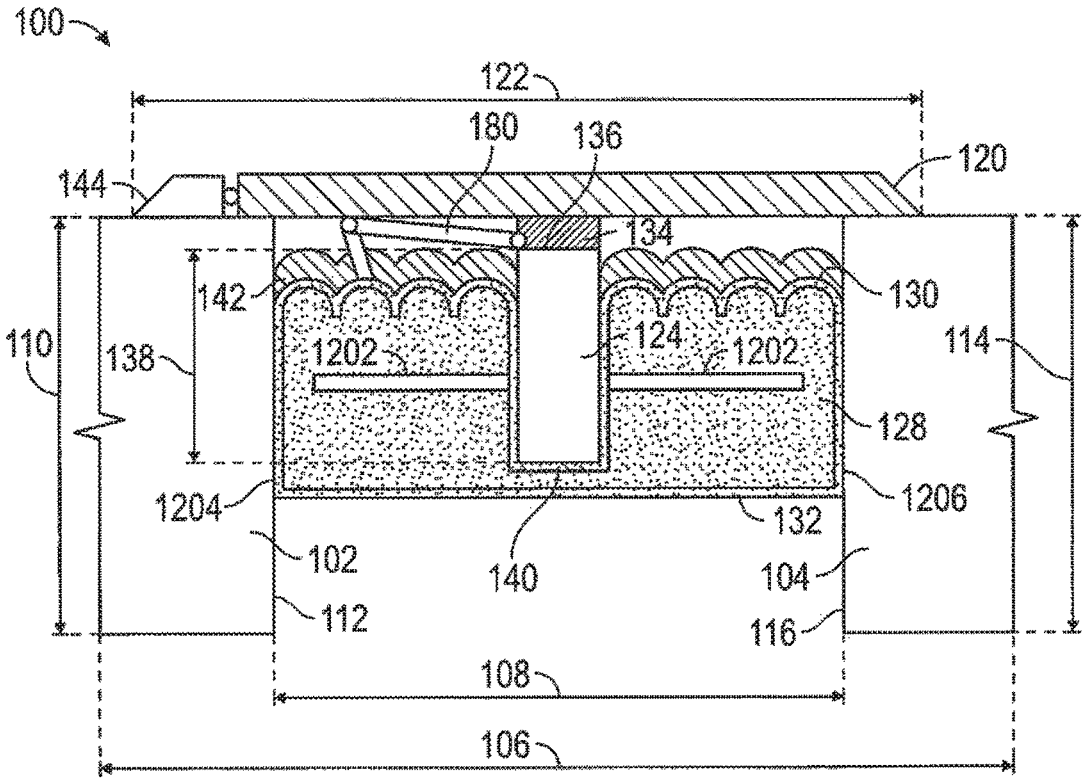
FIG. 12 provides an end view of an embodiment of the present disclosure.

For a similar benefit, a functional membrane 1202 may be imposed between layers of the elastically-compressible core 128, as illustrated in FIG. 12. The functional membrane 1202 extends across the elastically-compressible core 128 but need not reach the first side 1204 of the elastically-compressible core 128 and need not reach the second side 1206 of the elastically-compressible core 128. The internal membrane 1202 may extend through the elastically-compressible core 128 above the core bottom surface 132 and above the core top surface 130, and positioned between a first side 1204 of the elastically-compressible core and the second side 1206 of the elastically-compressible core 128. Alternatively, the membrane 1202 may extend to each side 1204, 1206, or may extend beyond each side 1204, 1206 to provide an area of increased density in each elastically-compressible core and/or to provide a surface for adhesion to the substrates 102, 104. Selective injection/infusion or a functional membrane is particularly beneficial in providing dimensional support and stability. The membrane 1202 may provide a flat surface or may be provided with a springing shape, such as a sawtooth or sinusoidal provide, such that the membrane may function as an internal compression spring, providing restorative and ongoing expansion force to assist the elastically-compressible core 128 in maintaining a seal, or may be an extruded gland, wherein the springing force results in part from the gland's shape. This spring force may also be alternatively accomplished by, or supplemented by the imposition of a spring in the elastically-compressible core 128 between one substrate and the rib 128. Thus, the membrane 1202 provides a springing-force profile.

The membrane 1202 may be a polymer that cures or thermosets at temperatures between 65-260° C. and which is flexible until the exposure to a high temperature event. Due to the selective placement in the elastically-compressible core 128, the polymer does not provide a potential fuel source and can be placed where it will cure within the elastically-compressible core 128 in a fire event, such that it will not burn but will instead be heated to its reaction temperature, cure and provide a rigid structural support for the remainder of the elastically-compressible core 128. Elastically-compressible cores 128 with a density after compression of less than 200 kg/m$^3$ with the internal recovery member/membrane 1202 exhibit superior performance over elastically-compressible cores 128 having densities in excess of 200 kg/m$^3$ materials, as those higher densities in concert with high compression ratios can force the rib 124 or cover plate 120 up and/or out of the joint or cause the joint to push down due the higher density. When desired, the membrane 1202 may provide a connection to the adjacent first substrate 102 and/or the second substrate 104 and may provide noise dampening. The membrane 1202 may alternatively be positioned atop the elastically-compressible core 128, and provide a wear surface in the event the cover plate 120 is omitted or lost. The membrane 1202 can optionally be a conductive member or as a carrier for a wire or cable. The membrane 1202 can also have an internal tubing or conduit to allow for remedial waterproofing or other post installation features. The internal recovery member/membrane provides for movement greater than +/−7.5% with long term cycling capacity of greater than 7,300 equal to ten years of thermal cycling. Surprisingly, the internal recovery member/membrane further provides structural and fire resistance for EN 1366 type testing requiring joint cycling during the actual fire endurance testing which not known in the art.

The membrane 1202 may be positioned adjacent the elastically-compressible core 128 at the core surface top 130 and extend from a first side of the elastically-compressible core 128 to the second side of the elastically-compressible core 128 or may extend beyond one or more of the first side 1204 or the second side 1206, providing wings extending beyond those sides and which may be bonded to the adjacent substrates 102, 104 in an adhesive such as epoxy or intu epoxy or a sealant such as silicone or polyurethane, and which may be selected to have fire resistance.

The elastically-compressible core 128 may be shaped to aid in installation, such as by providing a trapezoidal shape, wherein the elastically-compressible core 128 is wider at the core surface top 130 than at the core bottom surface 132, such that the profile provides a nosing at the core surface top 130 at the first substrate 102 and noise dampening surface that supports the cover plate 120. Other shapes or profiles, including open sections or voids, that facilitate the movement and function of the expansion joint have been found to beneficial. Elastically-compressible cores with up to 50% open area or voids allow for highly desirable movement recovery such that the total density of the core volume can be doubled while retain excellent expansion joint properties. Lower density while providing the required back-pressure and recovery force is desirable such than materials for example, with a total volume density of less than 200 kg/m$^3$, provide the same functional properties as materials with a density greater than 200 kg/m$^3$.

When desired, the compressibility of the elastically-compressible core 128 may be altered by forming the elastically-compressible core 128 from two foams, or other elements, of differing compressibility, providing a different spring force on the two sides of the ribs 124. Unequal densities, and thus spring forces, may provide a desirable spring force in the direction of movement of the traffic above, such as a roadway or one side of a concourse, to return the ribs 124 to the original position and to avoid the potential for a compression set over time due to the unequal application of movement to the expansion joint seal system 100. This may be accomplished by the foam in the elastically-compressible core 128 on one side of the ribs 124 having a first foam body density and the foam in the elastically-compressible core 128 on opposing side of the ribs 124 having a second foam body density. In a further alternatively, the elastically-compressible core 128 may be composed of laminations of materials layer one atop another, rather than as laterally-adjacent elements. Thus, an elastically-compressible core 128 may comprise a first layer of an open-celled foam with fire retardant additives, whether by impregnation, infusion or any other methods known in the art, with a second layer of a more rigid and/or closed cell foam, such that the more rigid layer may comprise, for example, 10-25% of the total thickness, such that the first layer and the second layer each have a first density and second density, respectively, which are different. That second layer of the elastically-compressible core 128 may be selected to provide movement and compression in response to seismic cycling and be used for support or as a filler which resiliently tolerates high compression, such in a seismic event. That second layer of the elastically-compressible core 128 may have a rigidity with flexibility to maintain shape and volume under the application of force until a threshold is reached, after which the material permits compression without permanently damaged, and which returns to standard performance thereafter. The sequence of layering may be selected based on functionality—water resistance, fire resistance, and flexibility.

Alternatively, the composition of the elastically-compressible core 128 on one side of the ribs 124 may be homogenous, while the opposing side may be a composite, such as a laminate of two foams or extruded glands, or a combination thereof. In an alternative embodiment, the elastically-compressible core 128 may be a composite of a foam inner surrounded by an open or enclosed gland exterior, which may incorporate a membrane 1202.

In one embodiment, the elastically-compressible core 128 provides support to each of the ribs 124 from below. While each of the ribs 124 pierces, or is formed in situ with a void in the elastically-compressible core 128, the elastically-compressible core 128 at the core top surface 130, in this embodiment, the rib bottom surface 140 does not extend to the core bottom surface 132, although in may in another embodiment. As a result, the elastically-compressible core 128 is not pierced through by the ribs 124, though the rib 124 may extend partially or nearly to the core bottom surface 132. Additionally, the elastically-compressible core 128 provides lateral forces against each side of each of the ribs 124, maintaining each rib 124 in position relative to the two substrates 102, 104. Beneficially, where the ribs 124 do not pierce the elastically-compressible core 128, the elastically-compressible core 128 remains integral such that a portion of the elastically-compressible core 128 provides a seal against outside contaminates in the expansion joint, to seal and support the bottom of the rib 124, the rib bottom surface 140. The ribs 124 may be cast, laminated or bonded to the elastically-compressible core 128 or, where present, to membrane 1202, such as a rigid layer thereof, to provide structural, transfer or reduces transfer forces within the elastically-compressible core 128 or from its top to bottom.

The present disclosure thus provides a seal against contaminants following a rib 124 through the seal, and allows for extra wide joint systems without the added expense depth requirements of systems without a bottom support.

Figure 10:
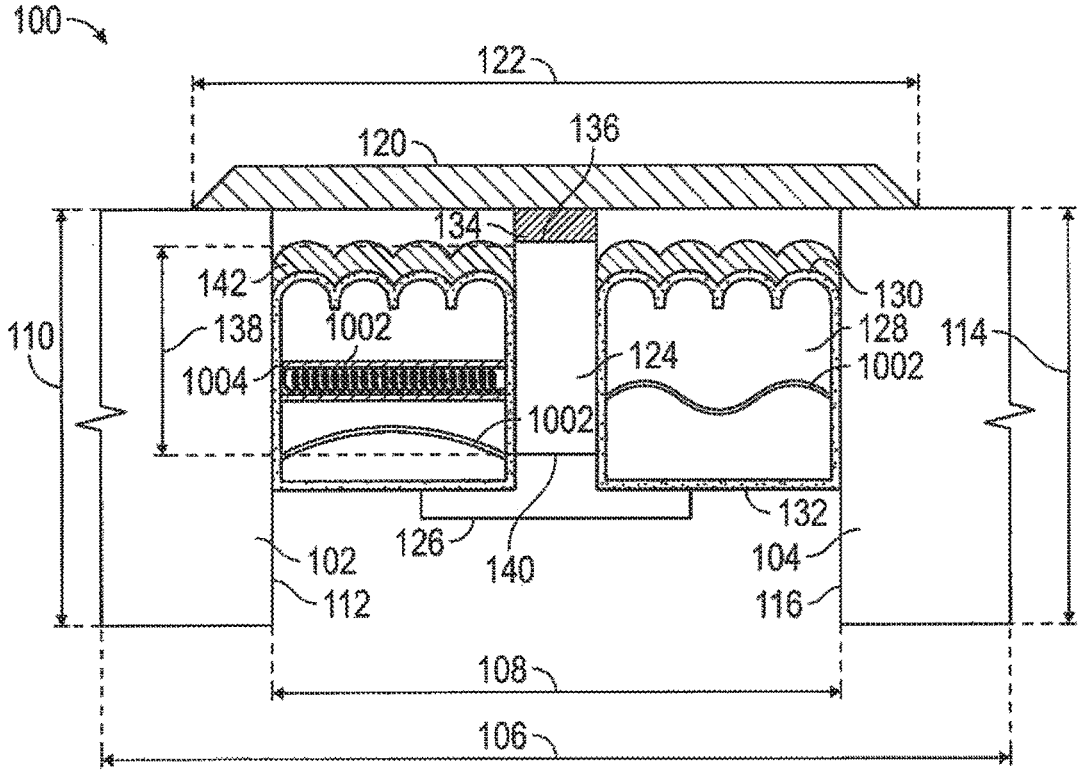
FIG. 10 provides an end view of an embodiment of the present disclosure incorporating a shock absorbing system.

Alternatively, the ribs 124 may extend through the core bottom surface 132. The rib 124 may therefore include or be connected to a flared base as illustrated in FIG. 10, which may provide contact with and upward support to the elastically-compressible core 128

Some or all of the ribs 124 may be electrically conductive or be composed, or contain, hydrophilic, hydrophobic or fire-retardant compositions, a carbon fiber material, and/or an intumescent material. In the event of a failure of the elastically-compressible core 128 to retard water or to inhibit water penetration, the hydrophilic or hydrophobic composition in a rib 124 may react to inhibit further inflow of water. Some or all of the ribs 124 may further include a radio frequency identification device to transmit internal data when needed or may include cathodic protections. Some or all of the ribs 124 may conductively connected and/or have data collection sensors such as pressure, force, strain and water or a combination of data collection sensors. Functional sensors or indicators, whether mechanical or electro-mechanical, may be used to provide data or permit visual information related to the expansion joint system 100, substrate 102, 104, or connected materials and assemblies. Upon failure of the elastically-compressible core 128 to retard water or to inhibit water penetration, a hydrophilic or hydrophobic composition on the rib 124 may react to inhibit further inflow of water. Additionally, each rib 124 may contain or bear an intumescing agent, so that upon exposure to high heat, the rib 124 may react, and provide protection to the expansion joint.

Where the elastically-compressible core 128 is an extruded gland, the rib 124 or ribs 124 may be part of the extrusion or be adhesively or heat bonded to the rib 124. As the extruded gland core can be solid or have an open matrix or structurally distinct sections, the elastically-compressible core 128 may further include a radio frequency identification device to transmit internal data when needed or may include cathodic protections, such as explained previously in connection with the ribs 124.

As provided in FIG. 4, each rib 124 need not descend directly downwardly from the cover plate 120. Ribs 124 may be curved or have other shape, and be angled laterally or longitudinally.

Referring to FIGS. 1, 2, 3A, 3B, 3C, and 3D, the expansion joint seal system 100 may be positioned in expansion joints that are not linear, such as those incorporating a curve or turn, such as a right-angle turn. Previous expansion joint seal systems, which incorporated a solid spine or spline, were incapable of this use, which is made possible by the use of flexible member 134 connecting the ribs 124 and the cover plate 120. The spaced-apart ribs permit fitting the expansion joint seal system 100 into the joint without breaking the support mechanism, as would occur with a fixed spline. Because the flexible member 134 permits the ribs 124 to be positioned between the substrates 102, 104 without reference to differences in the top of each substrate and the orientation of the cover plate 120, and because the ribs 124 are maintained laterally and from below by the elastically-compressible core 128, the operation of the expansion joint seal system 100 is maintained regardless of the vertical relationship of the two substrates 102, 104. This allows for proper movement when the deck comprising the two substrates 102, 104 is subject to vertical shear or deflection between decks.

Moreover, the expansion joint seal system 100 may be initially installed such that the ribs 124 are angled against the intended flow of traffic when the elastically-compressible core 128 is composed of three or more foam members, such that a foam at the top of the elastically-compressible core 128 which is to be in compression due to traffic is of a higher density and that the opposing side, lower edge is likewise of a higher density. Because the relative force of elastically-compressible core 128 determines the position of the ribs 124, equal densities maintain the elastically-compressible core 128 in an intermediate position, one which limits operation to a maximum of 50% of the joint width for compression. Varied densities in the elastically-compressible core 128 on the two sides of the ribs 124, provides an additional 10-20% more compressive resistance to traffic impact. This improvement may be particularly beneficial in situations such as the down ramp in a parking garage where traffic attempts to decelerate while traveling over the joint cover 120, as this repeated circumstance will wear out a joint based on materials which are evenly compressed and providing evenly offsetting forces.

The ribs 124 need not be uniformly positioned. The ribs 124 may be positioned in staggered relationship such that no more than one half of the elastically-compressible core 128 can be subject to compression. The balance of the elastically-compressible core 128 resists the compression outside direct force of the ribs 124. The portion of the elastically-compressible core 128 in compression may be further altered by angling the ribs 124 so as to subject less than half of an elastically-compressible core 128 to direct compression. This allows the balance of the elastically-compressible core 128 to be in a state of less compression and for the portion of the elastically-compressible core 128 have a less compression to run longitudinally along the joint such that at any one point in the length of the joint the elastically-compressible core 128 is in lower compression contact with the ribs 124, reducing compression set and creating a mechanical locking relationship between the elastically-compressible core 128 and the ribs 124. These ribs 124 may be attached to the force transfer plate 226. Moreover, by directing the various ribs 124 at differing angles within the 124, the ribs 124 may entangle the elastically-compressible core 128 so as to make it integral with the ribs 124 and, by extension, to the cover plate.

Figure 9:
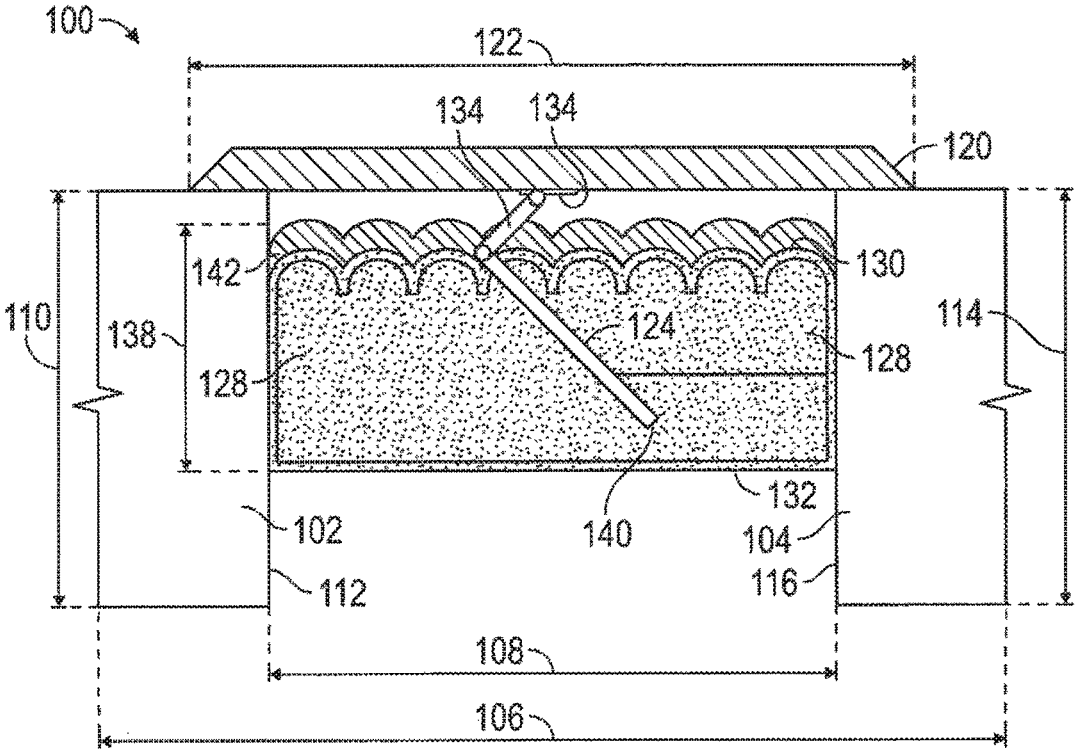
FIG. 9 provides an end view of an embodiment of the present disclosure.

Referring to FIG. 9, an illustration of an embodiment incorporating several of the preceding components. The flexible member 134 depicted in FIG. 8 is provided, along with an elastically-compressible core 128*a* and a second elastically-compressible core 128*b*, each having its own compression ratio, as well as an angled rib 124. The second elastically-compressible core 128*b*, which may be adjacent the elastically-compressible core 128*a*, thus has a second core body density, which is different from a core body density of the elastically-compressible core 128.

The joint seal 100 provided in FIG. 9 maintains the sealing properties of the elastically-compressible core 128*a* and the second elastically-compressible core 128*b* and the protection of the joint cover 120, while providing the benefits of the flexible member 134, the rib 124, and the varied compression ratio of the elastically-compressible core 128*a* and the second elastically-compressible core 128*b*, all of which serve to transfer loads from the cover plate 120 and to accommodate movement of all components.

Referring again to FIGS. 1 and 2, a coating 142 may be adhered to the elastically-compressible core 128 on its top surface 130. The coating 142 may be elastomeric or have a low modulus or flexible sealant capable of elongation greater than 500%, preferably vapor permeable to allow for moisture escape and thus reducing the potential of freezing of the expansion joint seal system 100. Where the elastomer 142 is not vapor permeable, a passage, such as a vent, may be included to provide for moisture escape. The elastomer 142 may also include intumescent compositions. The elastomer may be, for example, silicone, urethane or a membrane.

Alternatively, the elastically-compressible core 128 may be extruded or shaped in a bellows or wave configuration to facilitate compression so that the coating 124 may comprise an elastomer or high modulus or stiff sealant, capable of elongation of less than 500%. Higher modulus elastomers installed in this manner, in addition to water/UV/other properties, provide additional expansion force against the substrate that reduces the compression set in traditional density and compression ratios. Beneficially, this also increases the expansion recovery and adds structural support for an elastically-compressible core 128 of lower density, such as those that have a density, after installation of less than 200 kg/m$^3$, i.e. having an operable density of less than 200 kg/m$^3$. Further, this permits a compression of up to 80% and an extension of 100% from the installed mean gap/joint opening. The coating 128 may also be semi-rigid, permitting some compression while providing some restorative force. The coating 128 may be continuous or intermittently placed, or may be a combination of layers of a high modulus elastomer and a low modulus elastomer, depending on the desired function. Alternatively, the elastically-compressible core 128 may be selected from a material or composite having a higher density or configured with a higher compression ratio, such that the elastically-compressible core 128 has an operable density of at greater than 750 kg/m$^3$. Where the elastically-compressible core 128 has an overall high density, or a density which causes substantial difficulty in compressing to the designed joint width, the elastically-compressible core 128 may be provided with a shaped to remove material near the core bottom surface 132 such that the volume density is lower than the equal solid core density.

Referring to FIG. 10, an embodiment of the present disclosure incorporating a shock absorbing system is provided. To further absorb the impacts transferred from the cover plate 120 to the elastically-compressible core 128 by the ribs 124, the expansion joint seal system 100 may include a shock absorption system including a compression spring 1002, connected to one or more of the ribs 124 and extending laterally into the elastically-compressible core 128 or connected to the flexible member 134 and extending laterally to the end face 112, 116 of one or both of the adjacent substrates 102, 104. As illustrated in FIG. 10, the compression spring 1002 may extend fully through the elastically-compressible core 128, or may alternatively stop short, so as not to contact a substrate 102, 104. The compression spring 1002 may be positioned at any point on the rib 124 and may be selected from any spring known in the art, including a helical compression spring, a cylindrical compression spring, a plate spring, and may be a linear rate spring providing a constant rate, a progressive rate spring providing a variable rate or an adjustable rate, or a multiple rate spring, such as one providing a firm rate and a soft rate. Where the compression spring 1002 is a plate spring, it may be provided as an arc, with a sinusoidal pattern, or other energy-storing pattern. Where a coiled compression spring 1002 is utilized, the compression spring 1002 may be screwed into the elastically-compressible core 128 or may be encapsulated within a cylindrical housing 1004. The compression spring 1002 may be a single member extended across the ensure system 100 or may be positioned on only one side of the rib 124. Regardless of the structure selected, the compression spring 1002 increases the resistance to compression of the elastically-compressible core 128, buffers the ribs 124 against abrupt impact or shock, and reduces the likelihood of compression set in the elastically-compressible core 128, while the elastically-compressible core 128 provides damping force. The compression spring 1002 may include an end piece, which may be resistant to corrosion or which possesses less potential to damage the face 112, 116 of the adjacent substrate 102, 104. The end piece may be provided as any shape desired, such as a rubber cylinder in contact with the face 112, 116 of the adjacent substrate 102, 104 or may be presented as a larger member, such as a flange, which is captured within the elastically-compressible core 128 and therefore never contacts the face 112, 116 of the adjacent substrate 102, 104.

Figure 11:
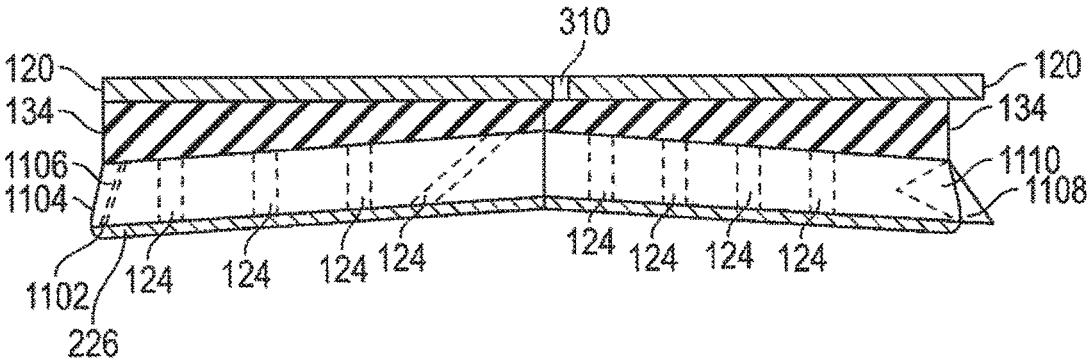
FIG. 11 provides a side view of an embodiment of the present disclosure facilitating shedding of liquid.

Referring to FIG. 11, a side view of an embodiment of the present disclosure facilitating shedding of liquid is provided. Because the flexible member 134 is attached to the cover plate 120 and to each of the plurality of ribs 124, the flexible member 134 may be a plurality of connectors of increasing height as depicted in FIG. 11, such as a plurality of separate second members 504 of FIG. 5, or a plurality of the first connectors 802, connecting members 806, and second connectors 804, or of consistent height as depicted in FIG. 4. Flexible member 134, whether provided as a single piece or as a plurality of connectors, may be provided so as increase per unit distance, so that the elastically-compressible core 128 and associated ribs 124 are skewed with respect to the cover plate 120, and thereby provide an incline to facilitate shedding of liquid within the joint between the substrates 102, 104 and above the elastically-compressible core 128. As illustrated in FIG. 11, when the system 100 is provided within a joint transitioning from a horizontal joint to a vertical joint, the system 100 may be provided to shed liquid out to the vertical edge, including by a drain 1102 through the elastically-compressible core 128, or by a drip edge 1104 which may be facilitated by an extending end 1106. The extending end 1106 may be provided as a portion of into the elastically-compressible core 128 or may be provided as a separate component 1108 with a piercing end 1110 which may be driven into the elastically-compressible core 128. To provide the system 100 in a rectangular prism shape, the elastically-compressible core 128 may be tapered to present the thinner end at the drain 1102, the drip edge 1104, the extending end 1106 or the component 1108. The top of the elastically-compressible core 128 may be provided with a sculpted top to direct liquid to one or both substrates 102, 104, or top a channel intermediate the two in the top of the elastically-compressible core 128. The transition may be any angle desired and may be sized to fit about a curve. The angle of the transition may preferably be at low as 30° and has high as 170°, although any angle may be obtained.

Figure 13:
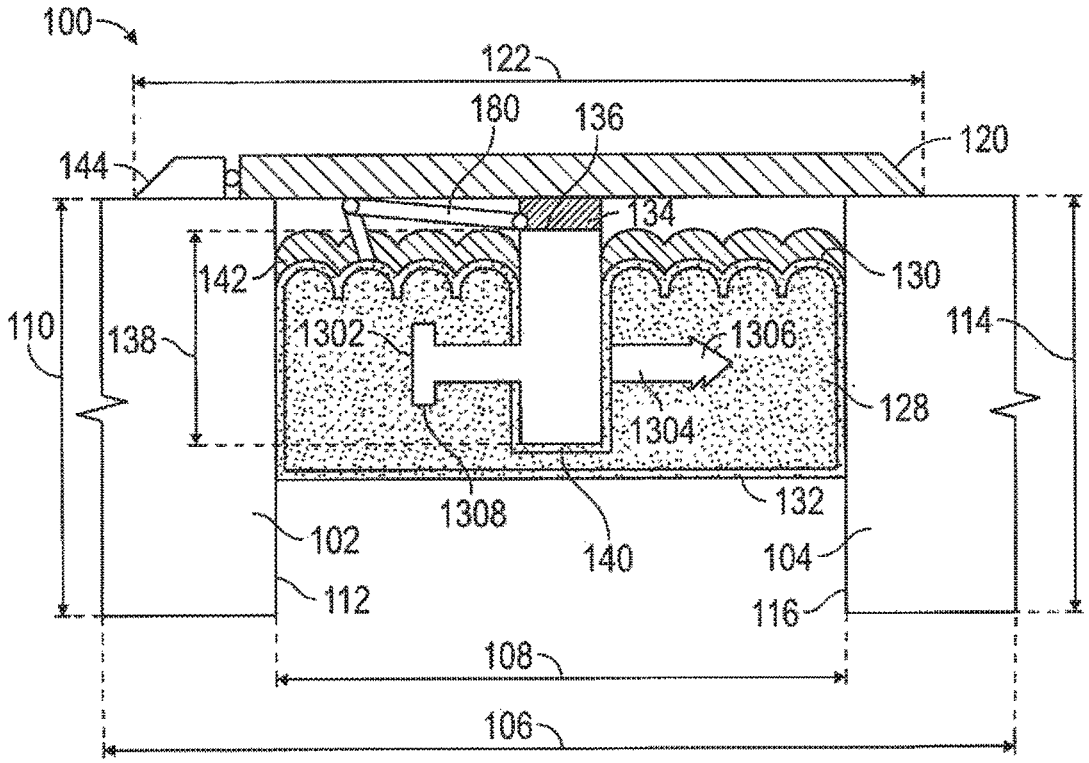
FIG. 13 provides an end view of an embodiment of the present disclosure.

Referring to FIG. 13, an embodiment of the present disclosure incorporating a keyed structure for relating the elastically-compressible core 128 to the rib 124 is provided. At least one of the plurality of ribs 124 may include a protuberance 1302 on a first side of the at least one of the plurality of ribs 124 extending laterally into the elastically-compressible core 128. The rib 124 may include a lateral protuberance 1302, which provides an extending member 1308, extending from the lateral protuberance 1302 at an angle about which the elastically-compressible core 128 may be fitted. In such an embodiment, the elastically-compressible core 128 is formed to include an internal void sized to fit about the lateral protuberance 1302 when the elastically-compressible core 128 is compressed. Alternatively, the rib 124 may include a lateral gig member 1304, which provides a lateral extending member with at least one blade 1306 or tooth which retards movement of the elastically-compressible foam away from the rib 124. The elastically-compressible core 128 may be formed to include an internal void sized to fit about the lateral gig member 1304 or may be laterally pierced by the lateral gig member 1304. As can be appreciated, the use of a lateral protuberance 1302 or lateral gig member 1304 may be used in alternative systems with one or more ribs and with, or without, a flexible member attached to the cover plate and to each of the plurality of ribs, wherein at least one of the plurality of ribs remains rotatable in relation to the cover plate.

The selection of components providing resiliency, compressibility, water-resistance and fire resistance, the system 100 may be constructed to provide sufficient characteristics to obtain fire certification under any of the many standards available. In the United States, these include ASTM International's E 814 and its parallel Underwriter Laboratories UL 1479 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multi-story Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E 136 "Behavior of Materials in a Vertical Tube Furnace at 750° C." (Combustibility), ASTM E 1399 "Tests for Cyclic Movement of Joints," ASTM E 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG(8*t+1) where t is time, in minutes, and T is temperature in degrees Celsius including E 814/UL 1479 and E 1966/UL 2079.

E 814/UL 1479 tests a fire-retardant system for fire exposure, temperature change, and resilience and structural integrity after fire exposure (the latter is generally identified as "the Hose Stream test"). Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1479 listing, it must pass both the fire endurance (F rating) and the Hose Stream test. The temperature data is only relevant where building codes require the T to equal the F-rating.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire-resistant system. The Hose Stream uses a stream of water. The stream is to be delivered through a 64 mm hose and discharged through a National Standard pipe of corresponding size equipped with a 29 mm discharge tip of the standard-taper, smooth-bore pattern without a shoulder at the orifice consistent with a fixed set of requirements:

| Hourly Fire Rating Time in Minutes | Water Pressure (kPa) | Duration of Hose Stream Test (sec./$m^2$) |
|---|---|---|
| 240 ≤ time < 480 | 310 | 32 |
| 120 ≤ time < 240 | 210 | 16 |
| 90 ≤ time < 120 | 210 | 9.7 |
| time < 90 | 210 | 6.5 |

The nozzle orifice is to be 6.1 m from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 m by an amount equal to 305 mm for each 10° of deviation from the normal. Some test systems, including UL 1479 and UL 2079 also provide for air leakage and water leakage tests, where the rating is made in conjunction with a L and W standard. These further ratings, while optional, are intended to better identify the performance of the system under fire conditions.

When desired, the Air Leakage Test, which produces an L rating and which represents the measure of air leakage through a system prior to fire endurance testing, may be conducted. The L rating is not pass/fail, but rather merely a system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure (STP) conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly and is less than 0.005 $L/s \cdot m^2$ at 75 Pa or equivalent air flow extraneous, ambient and elevated temperature leakage tests.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Non-hardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72 hour assessment.

The use of a membrane, such as membrane 1202 described above is one known system to provide a barrier sufficient for Air Leakage Test and for the Water Leakage Test. Other systems are known that do not include a barrier but instead rely on selection of foam and additives.

Another frequently encountered classification is ASTM E-84 (also found as UL 723 and NFPA 255), Surface Burning Characteristics of Burning Materials. A surface burn test identifies the flame spread and smoke development within the classification system. The lower a rating classification, the better fire protection afforded by the system. These classifications are determined as follows:

| Classification | Flame Spread | Smoke Development |
|---|---|---|
| A | 0-25 | 0-450 |
| B | 26-75 | 0-450 |
| C | 76-200 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall (head-of-wall) joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification (if used) | Minimum number of cycles | Minimum cycling rate (cycles per minute) | Joint Type (if used) |
|---|---|---|---|
| No Classification | 0 | 0 | Static |
| Class I | 500 | 1 | Thermal Expansion/Contraction |
| Class II | 500 | 10 | Wind Sway |
| Class III | 100 | 30 | Seismic |
| | 400 | 10 | Combination |

ASTM E 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated.

While the first body of compressible foam 120 has a first body fire rating, and the second body of compressible foam 128 has a second body fire rating, the first body fire rating need not be the same as the second body fire rating.

Moreover, while this first body of compressible foam 120 provides a primary sealant layer, it can be altered as a result of any water which permeates into it, as this changes its properties, thus fire-rating properties may differ in case of water penetration, a circumstance which must be accounted for in any testing regime. Fortunately, because the second body of compressible foam 128 is protected from water penetration by the barrier 134, the functional properties, such as the fire-rating properties, of the second body of compressible foam 128 are not compromised. Similarly, the second body of compressible foam 128 may be protected from deleterious materials, such as flowing chemicals, by the barrier 134. The current art does not provide for water and fire-resistant joints that can obtain listings or certifications to applicable fire tests such as UL 2079 or EN 1366 when the fire-resistant layer or material suffers from water penetration. A body's fire rating may include the temperature at which the body burns, or flame spreads, or, in conjunction with or as an alternative thereto, the time-duration at which a body passes any one of several test standards known in the art. In one embodiment, the first body fire rating is unequal to the second body fire rating. Selection of the fire rating for the various layers of the joint seal 100 may be made to address operational issues, such as a high fire rating for the first layer or body 120, which will be directly exposed to fire, but which may provide limited waterproofing, coupled with a second body of compressible foam 128 which may have a lower fire rating, but a higher waterproofing rating, to address the potential loss of the first body of compressible foam 120 in a fire. The first body of compressible foam 120 may be fire resistant but may ablate in response to exposure, shedding size or volume when exposed to high temperature or fire with the membrane separating it from other layers, which may retain their structural integrity or otherwise continue to provide some sealing function and providing functional properties during exposure. The selection of foam, fire retardant impregnation, thickness and compression after imposition may provide sufficient resilience to repeated compression to pass at least one of the cycling regimes for various fire rating and may likewise provide sufficient fire retardancy to rate at least a one-hour rating is desirable, through a 2, 3, or 4 hour rating may be preferable.

The system 100 may be supplied in individual components or may be supplied in a constructed state so that it may installed in an economical one step operation yet perform like more complicated multipart systems. The cover plate 120 can be solid continuous or be smaller segments to support the elastic-compressible core. The use of smaller cover plates 120 or bars to provide dimensional and/or compression support is beneficial in wide and shallow depth applications where products in the art will not work. A cover plate 120 may be supplied narrower than the joint gap which can then be slid, expanded, unfolded or rotated such that after unpackaging or installation, the cover plate 120 can span the joint gap. The cover plate 120 may be detachable or may be permanently attached. During installation, a depth setting or other support mechanism may be used, whether above or below the expansion joint. A support mechanism below the surface may left in place to provide structural support when required. Additional compressible core material 128 and/or ribs or splines 124 may be provided to supply support or sound dampening for the system 100.

The entire system 100 may be constructed such that a gap is present between the cover plate 120 and the elastically-compressible core 128 and a retaining band positioned about the elastically-compressible core 128 to maintain compression during shipping and before installation without additional spacers that would limit test fitting of the system 100 prior to releasing the elastically-compressible core 128 from factory compression. Packaging materials, that increase the bulk and weight of the product for shipping and handling to and at the point of installation, are therefore also eliminated.

The health of the system 100 may be assessed without alteration of the system 100, often accomplished by removal of the cover plate by the inclusion in the system 100 of sensors, such as radio frequency identification devices (RFIDs), which are known in the art, and which may provide identification of circumstances such as structural damage or moisture penetration and accumulation. The sensors may include CCD devices, and may include cameras, which may be fixedly placed on the elastically-compressible core 128, a rib 124, the, flexible member 134, or the cover plate 120.

The radio frequency identification device may be in contact with one of the cover plate 120, at least one of the plurality of ribs 124, the elastically-compressible core 128, and the flexible member 134. The inclusion of a sensor in the system 100 may be particularly advantageous in circumstances where the system 100 is concealed after installation, particularly as moisture sources and penetration may not be visually detected. Thus, by including a low cost, moisture-activated or sensitive sensor at the core bottom surface 132, the user can scan the system 100 for any points of weakness due to water penetration. A heat sensitive sensor may also be positioned within the system 100, particularly on or in the elastically-compressible core 128, thus permitting identification of actual internal temperature, or identification of temperature conditions requiring attention, such as increased temperature due to the presence of fire, external to the joint or even behind it, such as within a wall. Such data may be particularly beneficial in roof and below grade installations where water penetration is to be detected as soon as possible.

Inclusion of sensors may provide substantial benefit for information feedback and potentially activating alarms or other functions within the joint sealant or external systems. Fires that start in curtain walls are catastrophic. High and low pressure changes have deleterious effects on the long-term structure and the connecting features. Providing real time feedback from sensors, particularly given the inexpensive cost of such sensors, in those areas and particularly where the wind, rain and pressure will have their greatest impact would provide benefit. While the pressure on the wall is difficult to measure, for example, the deflection in a pre-compressed sealant is quite rapid and linear. Additionally, joint seals are used in interior structures including but not limited to bio-safety and cleanrooms. The rib 124 may be selected of a heat-conducting material and positioned in communication with the sensor. Additionally, a sensor could be selected which would provide details pertinent to the state of the Leadership in Energy and Environmental Design (LEED) efficiency of the building. Additionally, such a sensor, such as an RFID, which could identify and transmit air pressure differential data, could be used in connection with masonry wall designs that have cavity walls or in the curtain wall application, where the air pressure differential inside the cavity wall or behind the cavity wall is critical to maintaining the function of the system and can warn of impending failure. Sensors may be positioned in other locations within the joint seal 100 to provide beneficial data. A sensor may be positioned within the elastically-compressible core 128 at or near the core top surface 130 to provide prompt notice of detection of heat outside typical operating parameters, so as to indicate potential fire or safety issues. Such a positioning would be advantageous in horizontal of confined areas. A sensor positioned so positioned might alternatively be selected to provide moisture penetration data, beneficial in cases of failure or conditions beyond design parameters. The sensor may provide data on moisture content, heat or temperature, moisture penetration, and manufacturing details. A sensor may provide notice of exposure from the surface of the joint seal 100 most distant from the base of the joint. Sensors may further provide real time data. Using moisture sensitive sensors, such as RFIDs, in the system 100 and at critical junctions/connections would allow for active feedback on the waterproofing performance of the system 100. It can also allow for routine verification of the watertightness with a hand-held sensor reader, particularly an RFID reader, to find leaks before the reach occupied space and to find the source of an existing leak. Often water appears in a location much different than it originates making it difficult to isolate the area causing the leak. A positive reading from the sensor alerts the property owner to the exact location(s) that have water penetration without or before destructive means of finding the source. The use of a sensor in the system 100 is not limited to identifying water intrusion but also fire, heat loss, air loss, break in joint continuity and other functions that cannot be checked by non-destructive means. Use of a sensor within the elastically-compressible core 128 may provide a benefit over the prior art. Impregnated foam materials, which may be used for the elastically-compressible core 128, are known to cure fastest at exposed surfaces, encapsulating moisture remaining inside the body, and creating difficulties in permitting the removal of moisture from within the body. While heating is a known method to addressing these differences in the natural rate of cooling, it unfortunately may cause degradation of the foam in response. Similarly, while forcing air through the foam bodies may be used to address the curing issues, the potential random cell size and structure impedes airflow and impedes predictable results. Addressing the variation in curing is desirable as variations affect quality and performance properties. The use of a sensor within the body may permit use of the heating method while minimizing negative effects. The data from the sensors, such as real-time feedback from the heat, moisture and air pressure sensor, aids in production of a consistent product. Moisture, heat, and pressure sensitive sensors aid in determining and/or maintaining optimal impregnation densities, airflow properties of the foam during the curing cycle of the foam impregnation. Placement of the sensors into foam at the pre-determined different levels allows for optimum curing allowing for real time changes to temperature, speed and airflow resulting in increased production rates, product quality and traceability of the input variables to that are used to accommodate environmental and raw material changes for each product lots. Sensors, such as RFIDs or NFCs (near field communication devices), may be installed in the elastically-compressible core 128 to record actual manufacturing lot data, product, manufacturer and performance data such as a three hour UL 2079 listing or a movement rating. The data can be stored on the NFC during production directly from RFID or other sensor data to provide for accurate lot tracking, quality assurance and process improvement. The NFC can be read or updated before, during and after installation. Post installation uses may include recording other sensor data, storing warranty and service history as well as the ability to validate the correct material or rated material was installed. For example, an RFID installed in a building's structure may provide data for product improvement and for building status, which may be accumulated over time for further analysis and use, such as by constructors, designers, and/or property owners.

The present system 100 may be provided in transitions as provided previously, as unions, and in other configurations. The ribs 124 associated with a first flexible member 134 and a cover plate 120 may pierce into or be formed in a second elastically-compressible core 128 to overlap the attachment between adjacent expansion joint seal system 100, particularly when the first and second expansion joint seal systems 100 are overlapping, such as a transition or union.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

I claim:

1. An expansion joint seal comprising:

a cover plate, an elastically-compressible core having a core bottom surface, and a core top surface, a rib piercing the elastically-compressible core at the core top surface, a flexible member attached to the cover plate and to the rib, the flexible member having a cylindrical second member and a partial open cylinder first member, partial open cylinder first member interlocked about and partially encircling the cylindrical second member, one of the partial open cylinder first member and the cylindrical second member having a ball detent and the other having a mating detent, and wherein the rib remains rotatable in relation to the cover plate.

2. The expansion joint seal of claim 1, further comprising:

a force transfer plate having a force transfer plate length, the force transfer plate being fixedly attached to the rib, the force transfer plate providing upward support to the elastically-compressible core, the force transfer plate maintained in position by connection to the elastically-compressible core and adapted to contact one or more points on a substrate, and the cover plate length and the force transfer plate length being equivalent.

3. The expansion joint seal of claim 2, further comprising:

a second elastically-compressible core, the second elastically-compressible core having a second core body density;

wherein the elastically-compressible core has a core body density, the core body density being unequal to the second core body density;

the second body of elastically-compressible core adjacent the elastically-compressible core.

4. The expansion joint seal of claim 1, wherein the flexible member includes a first hinged connector, a second hinged connector and a connecting member intermediate the first hinged connector and the second hinged connector.

5. The expansion joint seal of claim 1, further comprising:

a tether attached to the elastically-compressible core and to the cover plate.

6. The expansion joint seal of claim 1, wherein the cover plate is rotatably attached to the flexible member to permit rotation in the horizontal plane above the core top surface.

7. The expansion joint seal of claim 1, wherein the cover plate includes a closed elliptical slot in a cover plate bottom and wherein the flexible member is attached to the cover plate at the closed elliptical slot.

8. The expansion joint seal of claim 7, further comprising a force-dissipating device and an end of the closed elliptical slot.

9. The expansion joint seal of claim 2, further comprising a compression spring, the compression spring connected to the rib and extending laterally into the elastically-compressible core.

10. The expansion joint seal of claim 9, further comprising a cylindrical housing about the compression spring.

11. An expansion joint seal comprising:

a cover plate, an elastically-compressible core, the elastically-compressible core having a first layer and a second layer, a rib positioned between the first layer elastically-compressible core and the second layer core, and a flexible member attached to the cover plate and the rib, the flexible member having a cylindrical second member and a partial open cylinder first member, partial open cylinder first member interlocked about and partially encircling the cylindrical second member, one of the partial open cylinder first member and the cylindrical second member having a ball detent and the other having a mating detent, wherein the rib remains rotatable in relation to the cover plate.

12. An expansion joint seal comprising:

a cover plate, an elastically-compressible core having a core bottom surface, and a core top surface, a rib extending through the elastically-compressible core at the core top surface, the rib extending to the core bottom surface, and a flexible member attached to the cover plate and to the rib, the flexible member having a cylindrical second member and a partial open cylinder first member, partial open cylinder first member interlocked about and partially encircling the cylindrical second member, one of the partial open cylinder first member and the cylindrical second member having a ball detent and the other having a mating detent, wherein the rib remains rotatable in relation to the cover plate.

13. The expansion joint seal of claim 12, where the elastically-compressible core has an operable density of less than 200 kg/m$^3$.

14. The expansion joint seal of claim 12, where the elastically-compressible core has an operable density of greater than 750 kg/m$^3$.

15. The expansion joint seal of claim 12, where the elastically-compressible core is an extruded gland.

16. The expansion joint seal of claim 12, wherein the cover plate is rotatably attached to the flexible member to permit rotation in the horizontal plane above the core top surface.

17. The expansion joint seal of claim 10, further comprising an internal membrane, the internal membrane extending through the elastically-compressible core above the core bottom surface and above the core top surface, the internal membrane positioned between a first side of the elastically-compressible core and the second side of the elastically-compressible core.

18. The expansion joint seal of claim 1, wherein the flexible member has a tensile strength not in excess of 344.7 kPa.

19. The expansion joint seal of claim 1, wherein the rib is composed in part of a material selected from the group of a hydrophilic material, a hydrophobic material, a fire-retardant material, an electrically conductive material, a carbon fiber material, and an intumescent material.

20. The expansion joint seal of claim 1, wherein the elastically-compressible core is of a material selected from the group in part of one of a hydrophilic material, a hydrophobic material, a fire-retardant material, a sintering material.

21. The expansion joint seal of claim 1, where the elastically-compressible core has an uncompressed density of 50-300 kg/m$^3$.

22. The expansion joint seal of claim 21, wherein the elastically-compressible core is laterally compressed 10%-85%.

23. The expansion joint seal of claim 1, wherein the elastically-compressible core includes a foam having 90-200 pores per linear inch.

24. The expansion joint seal of claim 1, further comprising an intumescent body contacting the elastically-compressible core.

25. The expansion joint seal of claim 1, wherein the elastically-compressible core contains fire resistant materials.

26. The expansion joint seal of claim 1, wherein the rib includes a protuberance on a first side of the rib, the protuberance extending laterally into the elastically-compressible core.

27. The expansion joint seal of claim 1, further comprising a radio frequency identification device in contact with one of the cover plate, the rib, the elastically-compressible core, and the flexible member.

28. The expansion joint seal of claim 17, wherein the membrane provides a springing-force profile.

29. The expansion joint seal of claim 1, further comprising a spring within the elastically-compressible core and adjacent the rib.

30. The expansion joint seal of claim 1, wherein the elastically-compressible core has a width greater at the core surface top than a width of the elastically-compressible core at the core bottom surface.

31. The expansion joint seal of claim 10, further comprising a membrane adjacent the elastically-compressible core at the core surface top extending from a first side of the elastically-compressible core to a second side of the elastically-compressible core.

32. The expansion joint of claim 1, wherein the cover plate has a plurality of openings therethrough.

33. The expansion joint of claim 1, wherein the flexible member is attached to one of the cover plate and the rib with a breakaway pin.

34. The expansion joint of claim 1, further comprising an internal membrane extending laterally beyond at least one of a first side and a second side of the elastically-compressible core.

* * * * *